US006405140B1

(12) United States Patent
Chen et al.

(10) Patent No.: US 6,405,140 B1
(45) Date of Patent: Jun. 11, 2002

(54) SYSTEM AND METHOD FOR PAPER WEB TIME-BREAK PREDICTION

(75) Inventors: Yu-To Chen, Niskayuna; Piero Patrone Bonissone, Schenectady, both of NY (US)

(73) Assignee: General Electric Company, Schenectady, NY (US)

( * ) Notice: Subject to any disclaimer, the term of this patent is extended or adjusted under 35 U.S.C. 154(b) by 119 days.

(21) Appl. No.: 09/583,155

(22) Filed: May 30, 2000

Related U.S. Application Data

(60) Provisional application No. 60/154,127, filed on Sep. 15, 1999.

(51) Int. Cl.[7] ..... G01B 5/30

(52) U.S. Cl. ..... 702/35; 73/865.8

(58) Field of Search ..... 702/35, 36, 85, 702/115, 182, 183, 184; 162/263; 73/598, 606, 649, 767, 794, 865.8; 34/117, 445

(56) References Cited

U.S. PATENT DOCUMENTS

| | | | | |
|---|---|---|---|---|
| 4,335,316 A | | 6/1982 | Glanz et al. | |
| 5,013,403 A | * | 5/1991 | Chase | 162/198 |
| 5,036,706 A | | 8/1991 | Gnuechtel et al. | |
| 5,104,488 A | * | 4/1992 | Chase | 162/198 |
| 5,130,557 A | | 7/1992 | Kettl | |
| 5,301,866 A | | 4/1994 | Veh et al. | |
| 5,314,581 A | * | 5/1994 | Lin et al. | 162/263 |
| 5,467,194 A | | 11/1995 | Pellinen et al. | |
| 5,652,388 A | | 7/1997 | Callan et al. | |
| 5,884,415 A | * | 3/1999 | Sims et al. | 34/117 |
| 5,942,689 A | | 8/1999 | Bonissone et al. | |
| 6,319,362 B1 | * | 11/2001 | Huhtelin et al. | 162/190 |

OTHER PUBLICATIONS

GA Smook, "Handbook for Pulp & Paper Technologists", 1934, pp. 179–243, 286–289, 307–316.

HC Schwalbe, "Papermaking and Paperboard Making", pp. 19–102.

TM Gallagher, Et Al, "Retention: The Key to Efficient Papermaking", 1992 Wet End Operations Short Course, pp. 461–465, 468–472.

G. Gavelin, "Fourdrinier Papermaking", Lockwood Trade Journal Co, 1963, Chapters 8 & 9, pp. 159–181.

"1993 Wet End Operations Short Course", 1993, Tappi Press, Atlanta, GA, ISBN 0–89852–879–8, pp. 29–52, 271–292, 341–349,527–546.

J. Lampinen, Et Al, "Optimization and Simulation of Quality Properties in Paper Machine with Neural Networks", 1994 IEEE, pp. 3812–3815.

JR Amyot, Et Al, "Configurability in a Diagnostic Expert System for Paper Machine Dryer Sections" 8 Pages, 1994.

J. Kline, "Paper and Paperboard Manufacturing and Converting Fundamentals", Sec. 1 pp 10–18; 29–36; Sec. 2 pp 71–88; 89–126, 221–228.

* cited by examiner

*Primary Examiner*—Marc S. Hoff
*Assistant Examiner*—Edward Raymond
(74) *Attorney, Agent, or Firm*—David C. Goldman; Jill M. Breedlove

(57) ABSTRACT

A system and method for generating a time-to-break prediction for a paper web in a paper machine. This invention uses principal components analysis, neuro-fuzzy systems and trending analysis to form a model for predicting the time-to-break of the paper web from sensor measurements of paper machine process variables. The model is used to isolate the root cause of the predicted web break.

46 Claims, 22 Drawing Sheets

SYSTEM AND METHOD FOR PAPER WEB TIME-BREAK PREDICTION

CROSS REFERENCE TO RELATED APPLICATIONS

This application claims the benefit of U.S. Provisional Application Serial No. 60/154,127 filed on Sep. 15, 1999, and entitled "Methods For Predicting Time-To-Break Wet-End Web In Paper Mills Using Principal Components Analysis, Neurofuzzy Systems and Trending Analysis," which is incorporated by reference herein in its entirety.

BACKGROUND OF THE INVENTION

This invention relates generally to a paper machine, and more particularly, to a system and method for predicting web break sensitivity in the paper machine and isolating machine variables affecting the predicted web break sensitivity.

A paper machine of the Fourdrinier-type typically comprises a wet-end section, a press section, and a dry-end section. At the wet-end section, the papermaking fibers are uniformly distributed onto a moving forming wire. The moving wire forms the fibers into a sheet and enables pulp furnish to drain by gravity and dewater by suction. The sheet enters the press section and is conveyed through a series of presses where additional water is removed and the web is consolidated (i.e., the fibers are forced into more intimate contact). At the dry-end section, most of the remaining water in the web is evaporated and fiber bonding develops as the paper contacts a series of steam-heated cylinders. The web is then pressed between metal rolls to reduce thickness and smooth the surface and wound onto a reel.

A problem associated with the Fourdrinier-type paper machine is that the paper web is prone to break at both the wet-end section of the machine and at the dry-end section. Web breaks at the wet-end section, which typically occur at or near the site of its center roll, occur more often than breaks at the dry-end section. Dry-end breaks are relatively better understood, while wet-end breaks are harder to explain in terms of causes and are harder to predict and/or control. Web breaks at the wet-end section can occur as much 15 times in a single day. Typically, for a fully-operational paper machine there may be as much as 35 web breaks at the wet-end section of the paper machine in a month. The average production time lost as a result of these web breaks is about 1.6 hours per day. Considering that each paper machine operates continuously 24 hours a day, 365 days a year, the downtime associated with the web breaks translates to about 6.66% of the paper machine's annual production, which results in a significant reduction in revenue to a paper manufacturer. Therefore, there is a need to reduce the amount of web breaks occurring in the wet-end section of a paper machine.

BRIEF SUMMARY OF THE INVENTION

This invention has developed a system and method for predicting a time-to-break for a paper web in either the wet-end section or the dry-end section of the paper machine. In addition, this invention is able to isolate the root cause of the predicted web break. Thus, in this invention, there is provided a plurality of sensors for obtaining a plurality of measurements from the paper machine. Each of the plurality of measurements relate to a paper machine process variable. A processor processes each of the plurality of measurements into a modified principal components data set. A break predictor, responsive to the processor, predicts a paper web time-to-break within the paper machine from the plurality of processed measurements.

DETAILED DESCRIPTION OF THE INVENTION

Figure 1:
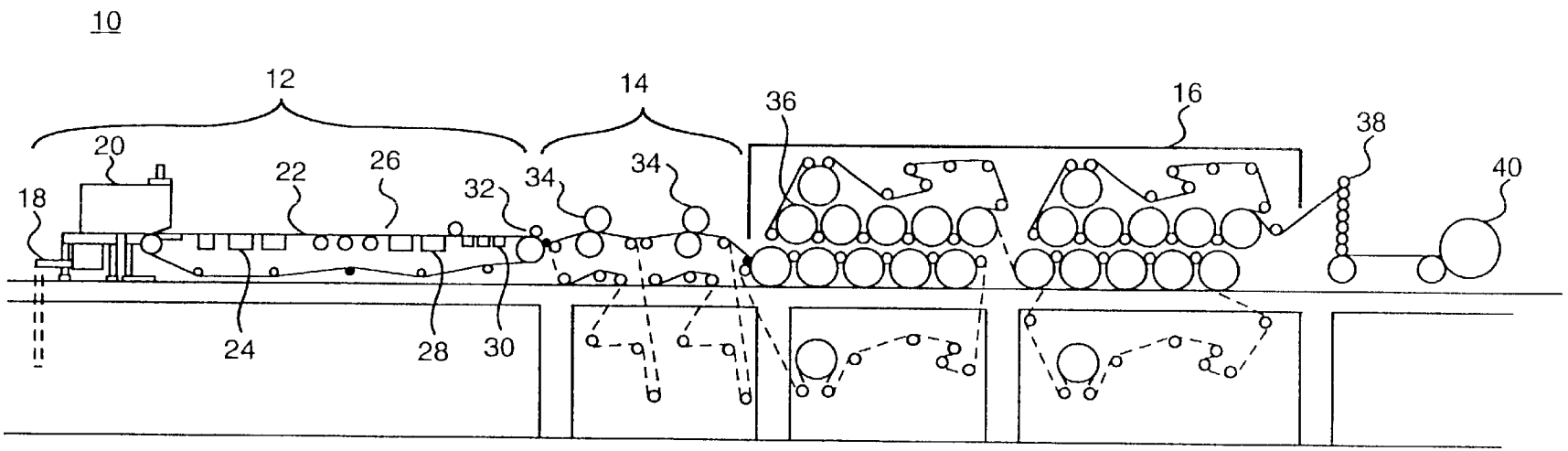
FIG. 1 PRIOR ART
FIG. 1 shows a schematic diagram of a paper machine according to the prior art.

FIG. 1 shows a schematic diagram of a paper machine 10 according to the prior art. The paper machine 10 comprises a wet-end section 12, a press section 14, and a dry-end section 16. At the wet-end section 12, a flowspreader 18 distributes papermaking fibers (i.e., a pulp furnish of fibers and filler slurry) uniformly across the machine from the back to the front. The papermaking fibers travels to a headbox 20 which is a pressurized flowbox. The pulp furnished is jetted from the headbox 20 onto a moving paper surface 22, which is an endless moving wire. The top section of the wire 22, referred to as the forming section, carries the pulp furnish. Underneath the forming section are many stationary drainage elements 24 which assist in drainage. As the wire 22 with pulp furnish travels across a series of hydrofoils or table rolls 26, white water drains from the pulp by gravity and pulsation forces generated by the drainage elements 24. Furnish consistency increases gradually and dewatering becomes more difficult as the wire 22 travels further downstream. Vacuum assisted hydrofoils 28 are used to sustain higher drainage and then high vacuum flat boxes 30 are used to remove as much water as possible. A suction couch roll 32 provides suction forces to improve water removal.

The sheet is then transferred from the wet-end section 12 to the press section 14 where the sheet is conveyed through a series of presses 34 where additional water is removed and the web is consolidated. In particular, the series of presses 34 force the fibers into intimate contact so that there is good fiber-to-fiber bonding. In addition, the presses 34 provide surface smoothness, reduce bulk, and promote higher wet web strength for good runnability in the dry-end section 16. At the dry-end section 16, most of the remaining water in the web is evaporated and fiber bonding develops as the paper contacts a series of steam-heated cylinders 36. The cylinders 36 are referred to as dryer drums or cans. The dryer cans 36 are mounted in two horizontal rows such that the web can be wrapped around one in the top row and then around one in the bottom row. The web travels back and forth between the two rows of dryers until it is dry. After the web has been dried, the web is transferred to a calendar section 38 where it is pressed between metal rolls to reduce thickness and smooth the surface. The web is then wound onto a reel 40.

Figure 2:
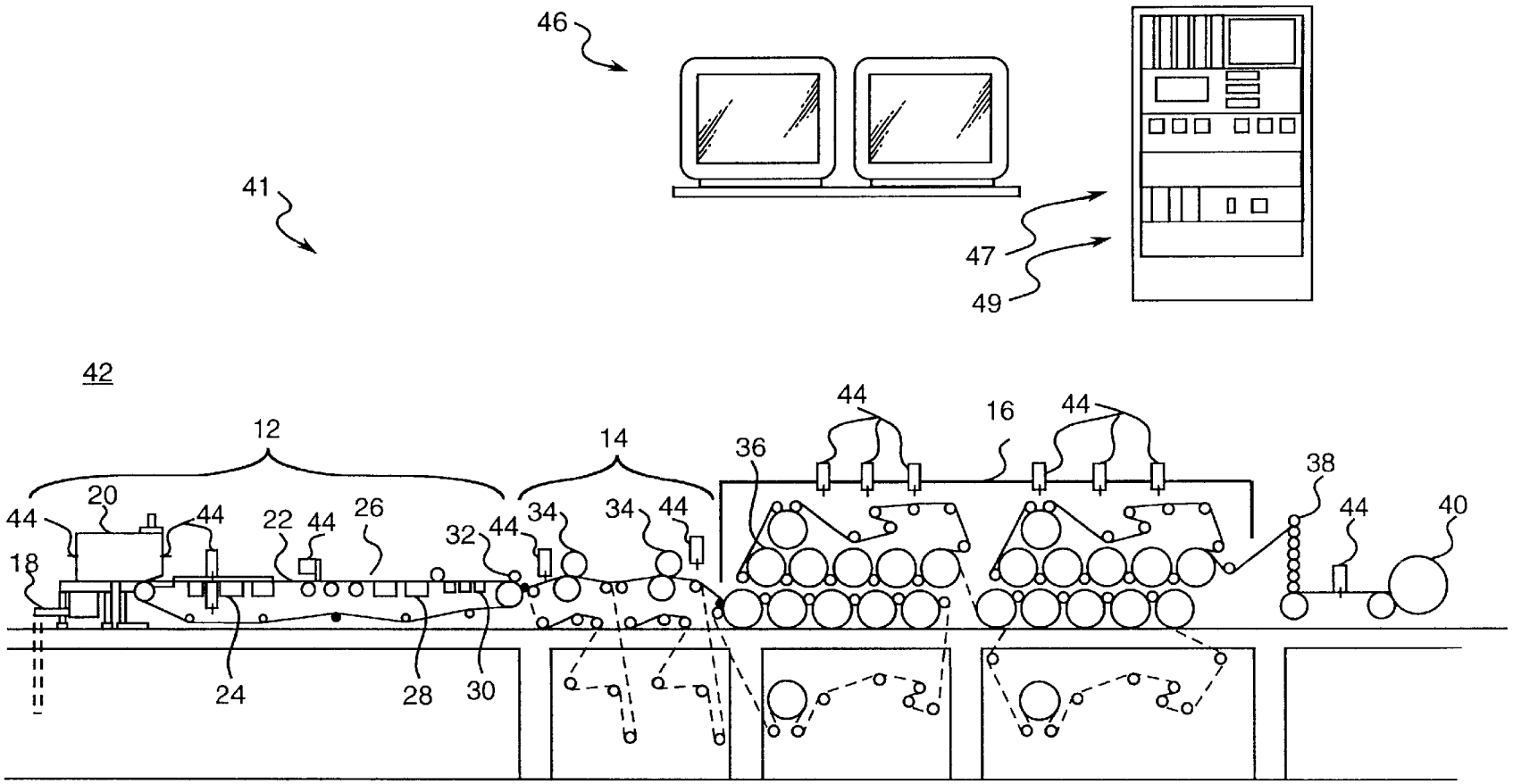
FIG. 2 shows a schematic of a paper machine used in this invention.

As mentioned earlier, the conventional paper machine is plagued with the paper web breaks at both the wet-end section of the machine and at the dry-end section. FIG. 2 shows a schematic of a system 41 that is capable of predicting paper web breaks and isolating the root causes for the breaks. In addition to elements described with respect to FIG. 1, the paper machine 42 comprises a plurality of sensors 44 for obtaining various measurements throughout wet-end section 12, the press section 14, and the dry-end section 16. There are hundreds of different types of sensors (e.g., thermocouples, conductivity sensors, flow rate sensors) located throughout the paper machine 42. For example, there may be as many as 374 sensors located throughout the wet-section of the paper machine 42. For ease of illustration, the sensors 44 are shown in FIG. 2 as substantially the same symbol even though there are many different types of sensors used that are typically designated by different configurations. Each sensor 44 obtains a different measurement that relates to a paper machine variable. Some examples of the type of measurements that may be taken are chemical pulp feed, wire speed, wire pit temperature, wire water pH, and ash content. Note that these measurements are only possible examples of some of the measurements obtained by the sensors 44 and this invention is not limited thereto. A computer 46, coupled to the paper machine 42, receives each of the measurements obtained from the sensors 44. The computer 46 preprocesses selected ones of the measurements and analyzes the preprocessed measurements according to a software-based predictive model 47 stored within its memory to determine a time-to-break of the paper web, which may be displayed by the computer.

Figure 3:
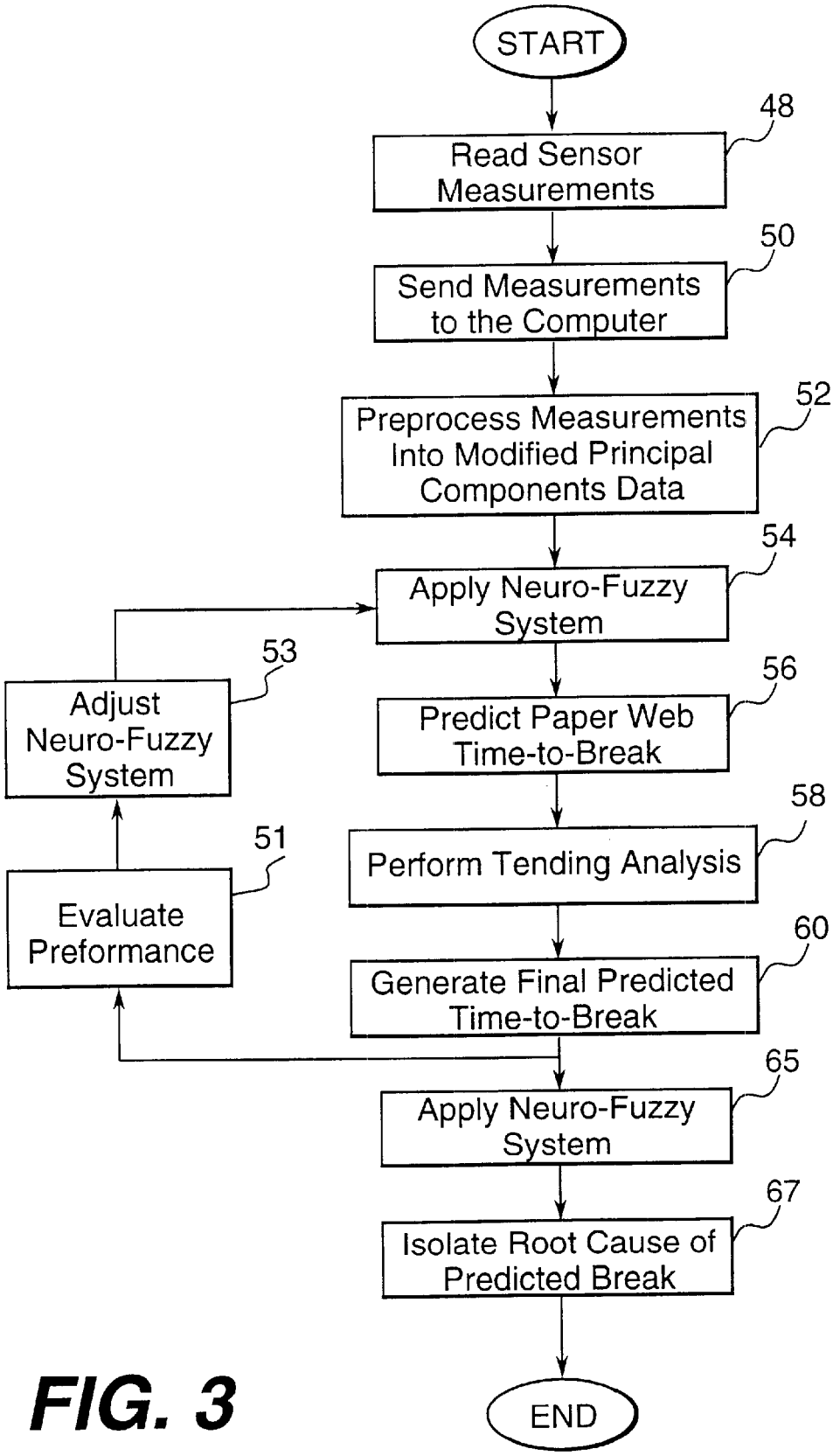
FIG. 3 is a flow chart setting forth the steps used in this invention to predict a paper web time-to-break in a paper machine and isolate the root cause of the break.

FIG. 3 is a flow chart setting forth the steps used by the computer in this invention to predict the paper web time-to-break in the paper machine 42 and to isolate the root cause of the break after the predictive model is sufficiently trained and tested. In FIG. 3, the plurality of sensors 44 located about the paper machine 42 are read at 48. Each of the sensor readings relate to a paper machine variable identified as a principal component affecting web breakage. As will be explained below, in one preferred embodiment, only about 3 input variables are used from 43 possible sensor readings. Those skilled in the art will realize that more or less input variables may be used in conjunction with this invention. After obtaining the sensor readings, the measurements are sent to the computer 46 at 50. The computer then preprocesses the measurements into a modified break sensitivity data set, including modified principal components at 52. In particular, in one preferred embodiment described in detail below, each of the measurements are transformed into principal components, clustered, normalized, transformed again and shuffled in preparation for use by a predictive model. This preprocessing generally reduces noise in the data and enhances the features of the data, thereby improving the signal to noise ratio of the data. After preprocessing, the computer 46 applies the predictive model to the preprocessed measurements at 54. In particular, the computer 46 uses a predictive modeling tool such as a neuro-fuzzy system to continually predict the time-to-break of the paper web from the incoming paper machine variables at 56. For example, the system may make a prediction over a predetermined time period, such as one prediction every 5 minutes. However, this prediction is not utilized until a trending analysis is performed to adjust the prediction for consistency with prior predictions at 58, as is explained below. Once a consistent trend is determined, a final prediction is made from the adjusted prediction at 60. The process repeats itself such that the final prediction is updated at the predetermined time period by other consistent predictions. Additionally, a performance evaluation of the final prediction is performed at 51 to measure the quality of the prediction. Depending on the results of the performance evaluation, at 53 the parameters of the neuro-fuzzy system may be adjusted to improve the accuracy of the prediction through a feedback mechanism, such as by modifying the software based on its output. Next, the neuro-fuzzy system is applied at 65 and its rule set is used to isolate the root cause of the predicted web break at 67. In isolating the root cause, the model outputs explanatory rules that link paper machine variables measured by the sensors to the predicted break sensitivity. The neuro-fuzzy system and the derived rules are described below in more detail. Thus, the output of the neuro-fuzzy system can be used as a proactive warning of a web break for use in taking corrective action to isolate the root cause of the predicted web break and reduce the probability of a web break.

In operation, it was found that a preferred method of alerting the operator about the advent of a higher break probability or break sensitivity is to use a stoplight metaphor, which consists of interpreting the output of the time-to-break predictor. When the time-to-break prediction enters the range of about 90 to about 60 minutes, an alert such as a yellow light is provided, indicating a possible increase in break sensitivity. When the predicted time-to-break value enters the range of about 60 to about 0 minutes, an alarm such as a red light is provided to warn of the imminent potential for a break. As one skilled in the art will realize, may other time ranges and alerts may be utilized, such as audible, tactile and other visual indicators.

Figure 4:
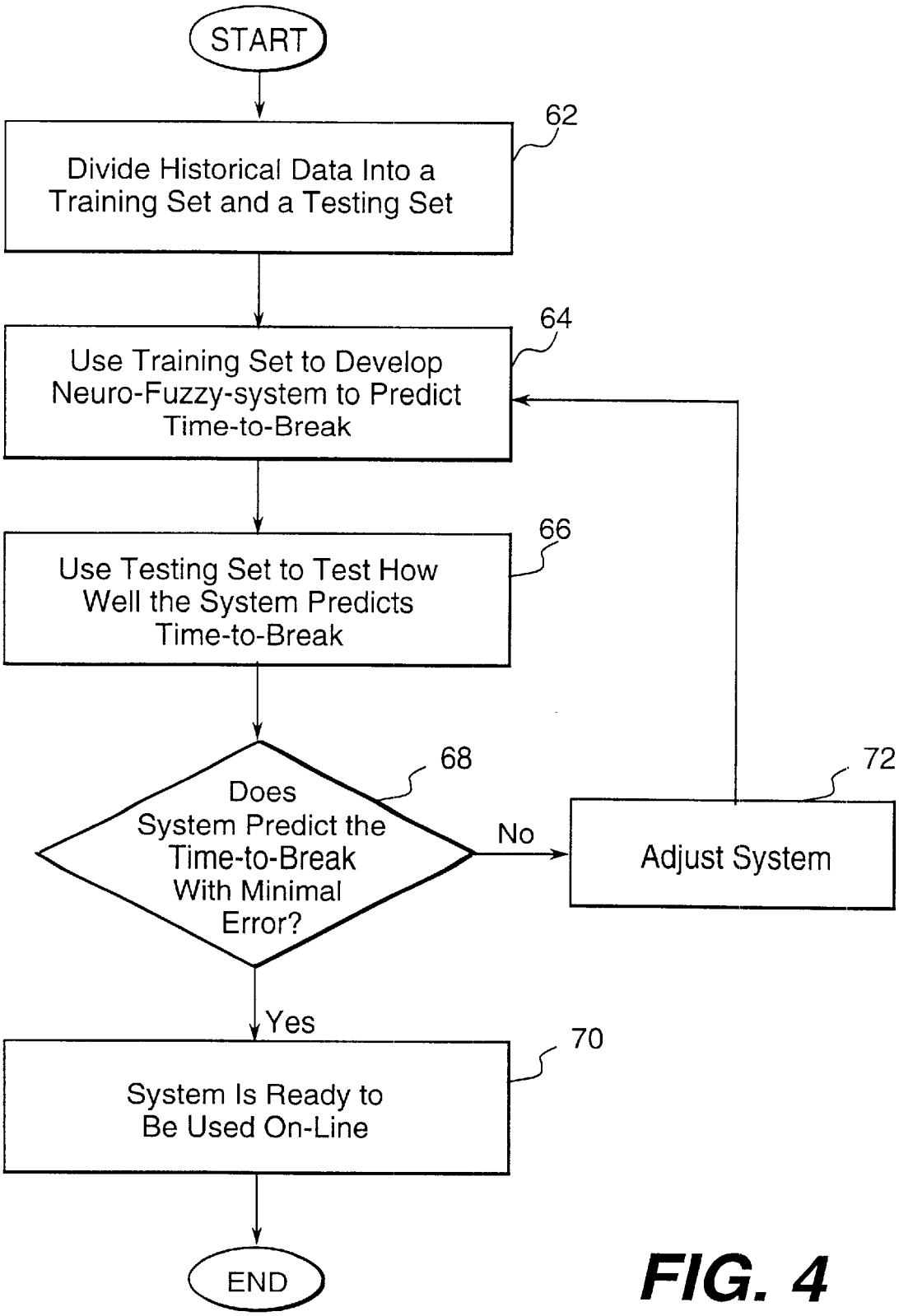
FIG. 4 is a flow chart setting forth the steps used to train and test the predictive model in this invention.

In order for this invention to be able to predict the time-to-break of the paper web and to isolate the root cause of the web break, the computer 46 containing the neuro-fuzzy system is trained and tested with historical web break data. For example, in one preferred embodiment, about 67% of the historical data is used for training and about 33% is used for testing. One skilled in the art will realize that these percentages may vary dramatically and still produce acceptable results. A flow chart describing the training and testing steps performed in this invention is set forth in FIG. 4. At 62, the historical data set is divided into two parts, a training set and a testing set. The training set is used to train the neuro-fuzzy system to predict the time-to-break and the testing set is used to test the prediction performance of the system when presented with a new data set. If the training is successful, then the model is expected to do reasonably well for a data set that it has never seen before. At 64, the training set is used to train the system to predict the time-to-break of the paper web. In this invention, the neuro-fuzzy system is trained by using the process described below in detail. Once the system is developed from the training set, the testing set is utilized to test how well the trained system predicts the time-to-break at 66. The testing is measured by calculating a prediction error, E(t). The prediction error is defined as: E(t)={Actual-time-to-break(t)−Predicted-time-to-break(t)}. If the trained system does predict the time-to-break with minimal error (e.g., −20 minutes>E(60)>40 minutes) at 68, then the system is ready to be used on-line at 70 to predict the break sensitivity. However, if the trained system is unable to predict the time-to-break with minimal error at 68, then the system is adjusted at 72 and steps 64–68 are repeated until the error becomes small enough. The adjustments to the system at 72 involve changing the parameters of the neuro-fuzzy system, such as the number of inputs and/or the number of membership functions per input.

In determining the prediction error, E(t), any number of ranges of prediction error at given times, t, may be utilized, depending on the particular paper machine and the given process variables. Clearly the best prediction occurs when the error between the real and the predicted time-to-break is zero. However, the utility of the error is not symmetric with respect to zero. For instance, if the prediction is too early (e.g., predicted time-to-break=60 minutes but actual time-to-break=90 minutes), then the prediction is providing more lead-time than needed to verify the potential for break, monitor the various process variables, and perform a corrective action. On the other hand, if the prediction is too late (e.g., predicted time-to-break=90 minutes but actual time-to-break=60 minutes), then this error reduces the time required to assess the situation and take a corrective action. Given the same error size, it is preferable to have a positive bias (early prediction), rather than a negative one (late prediction). On the other hand, there should be a limit on how early a prediction can be and still be useful.

Figure 5:
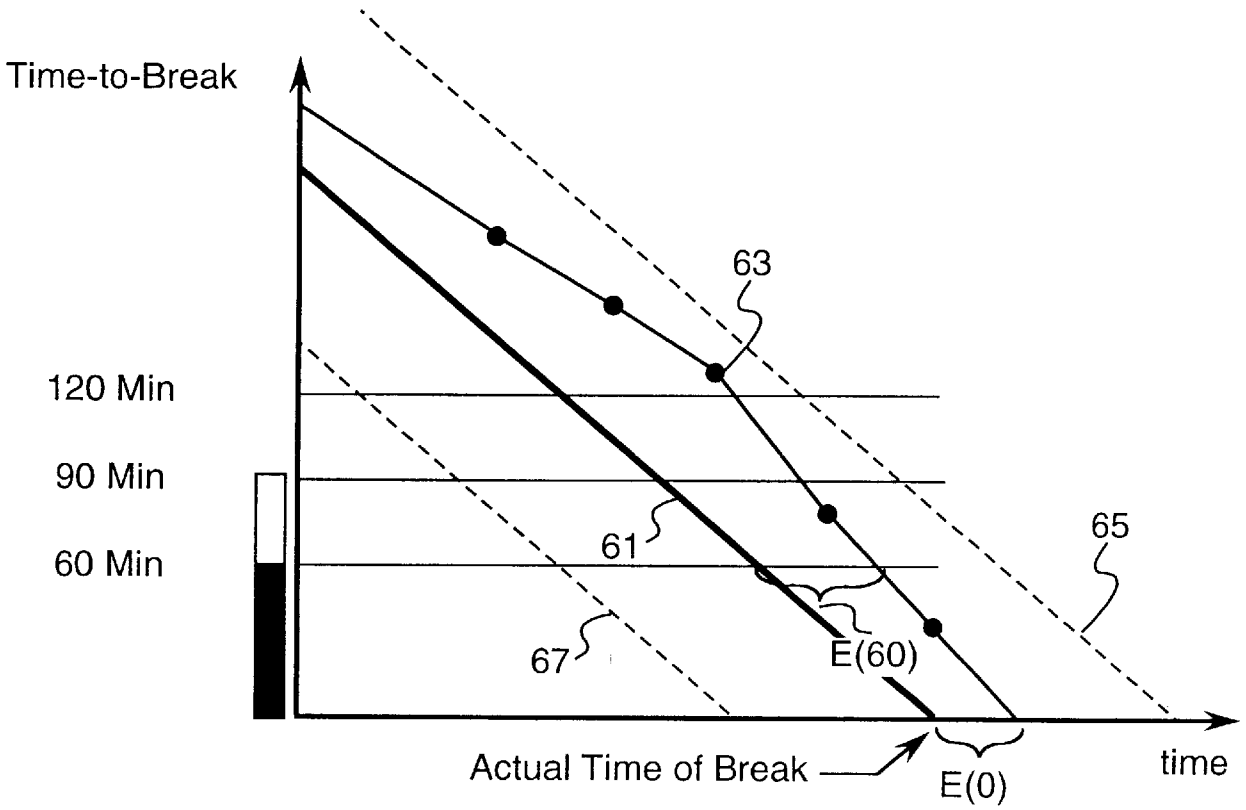
FIG. 5 is a plot of time-to-break versus time for the actual time-to-break and the predicted time-to-break, and illustrating upper and lower control limits and the prediction error at various points, as utilized in the present invention.

Therefore, in the preferred embodiment, boundaries are established for the maximum acceptable late prediction and the maximum acceptable early prediction. Any prediction outside of these boundaries will be considered a false prediction. For example, referring to FIG. 5, a predetermined useful prediction window is defined about the actual time-to-break line 61 for the predicted time-to-break line 63, having a late limit 65 outside which late predictions or false negatives occur resulting in not enough time to take action, and an early limit 67 outside which early predictions or false positives occur resulting in premature warning that may cause too many corrections. These extremes of false predictions, False Negatives (FN) and False Positives (FP), may be defined as follows. A False Negative (sometimes referred as a missing prediction) occurs when no predictions are made or when the predicted time-to-break is more than a predetermined late time period (e.g. 20 minutes) compared to the actual time-to-break. A False Positive (commnonly referred to as a false alarm) occurs when the predicted time-to-break is more than predetermined early time period (e.g. 40 minutes early) compared to the actual time-to-break. This is considered to be excessive lead-time, which might lead to unnecessary corrections. In the preferred embodiment, the following limits are defined as the maximum allowed deviations from the origin, where the origin equals the actual time-to-break line:

FN: E(60)<20 minutes: The system fails to correctly predict a break if the predicted time-to-break is more than 20 minutes later than the actual time-to-break. Note that if the prediction is later than 60 minutes, this is equivalent to not making any prediction and having the break occurring.

FP: E(60)>40 minutes: The system fails to correctly predict a break if the predicted time-to-break is more than 40 minutes earlier than the actual time-to-break.

Although these are subjective boundaries, they reflect the greater usefulness of having earlier rather then later warning/alarms.

Additionally, after the break predictor model 47 is trained to predict the time-to-break, a software-based fault isolator model 49 within the computer is trained and tested with the historical data to derive a set of rules that can explain the root cause any predicted time-to-break. The derivation of the rules from the neuro-fuzzy system may be utilized to pinpoint process variables, related to the sensor readings, that are responsible for the predicted paper web break.

Figure 6:
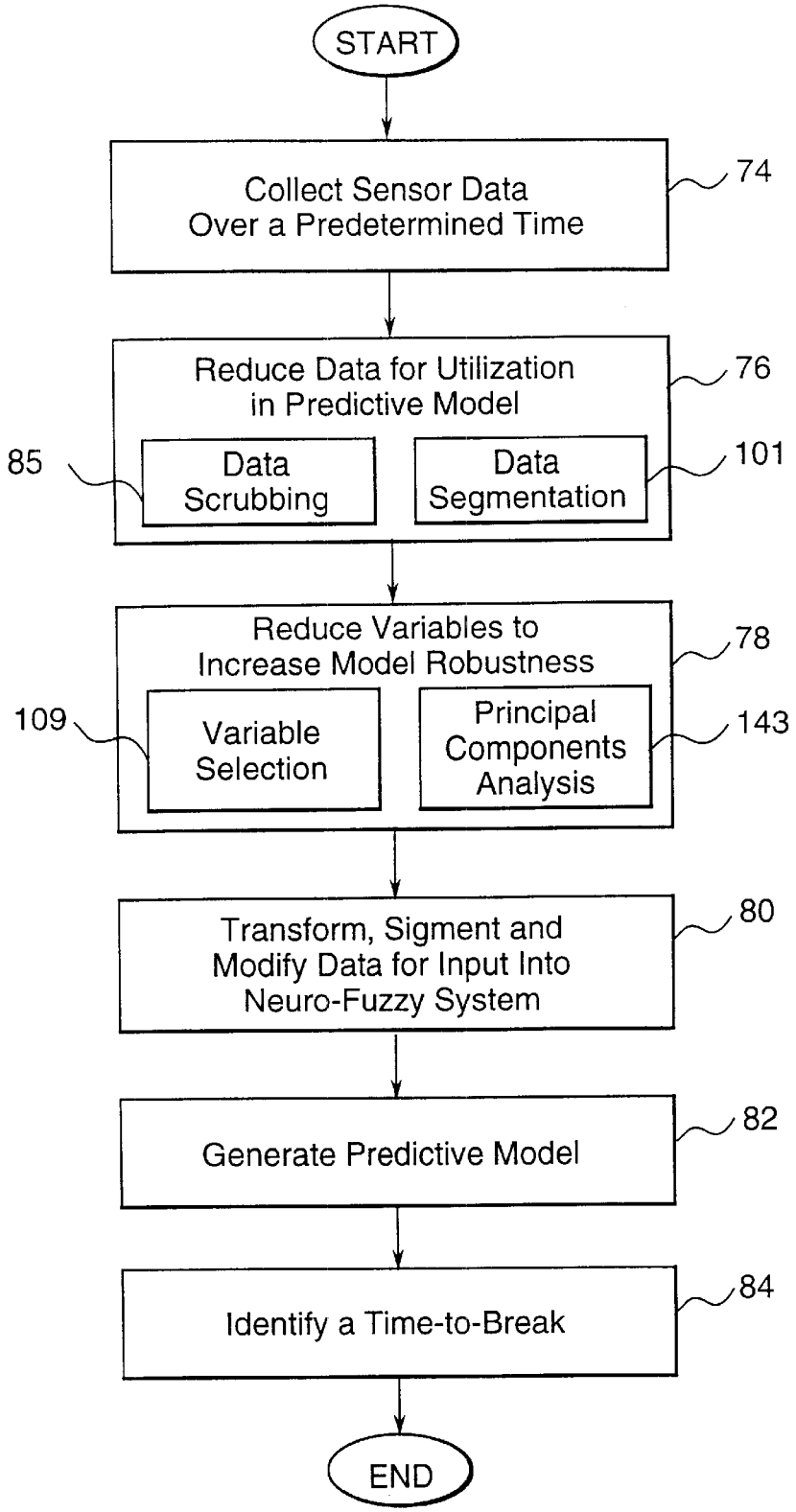
FIG. 6 is a flow chart setting forth the steps used in this invention to acquire historical web break data and preprocess the data.

FIG. 6 describes the historical web break data acquisition steps and the data preprocessing steps that are used in this invention for training. At 74, sensor data from a paper machine such as the machine described in FIG. 2 is collected over a predetermined time period. In the preferred embodiment, data collection may focus on one area of the machine, such as the wet-end section. After the historical data has been collected, then a data reduction process is applied at 76 to render the historical data suitable for model building purposes. In the preferred embodiment, the data reduction is subdivided into a data scrubbing process and a data segmentation process. Following the data reduction, a variable reduction technique is utilized at 78 in order to derive a simple, yet robust, predictive model. In the preferred embodiment, the variable reduction is subdivided into a variable selection process and a principal components analysis process, as is discussed below in detail. Once the amount of data and the number of variables are reduced, then the data is further segmented to develop local models and modified in preparation for use by the neuro-fuzzy system at 80. The further segmentation and modification of the data is discussed below in detail. This data is processed by the neuro-fuzzy system to generate a predictive model at 82. This predictive model is used to predict a time-to-break that is compared to prior predictions in a trend analysis process, resulting in a final predicted time-to-break at 84. Thus, the data acquisition and training results in a predetermined number of local models for continually predicting the time-to-break of a paper web based on the incoming paper machine variable measurements.

The data gathering and model generation process will now be described in detail with reference to a preferred embodiment. Those skilled in the art will realize that the principles taught herein may be applied to other embodiments. As such, the present invention is not limited to this preferred embodiment. In one preferred embodiment, sensor data from 43 sensors located about the wet-end section of the paper machine are collected over about a twelve-month period. Note that this time period is illustrative of a preferred time period for collecting a sufficient amount of data and this invention is not limited thereto. Additional variables associated with the sensor measurements include two variables corresponding to date and time information and one variable indicating a web break. By using a sampling time of one minute, this data collection results in about 66,240 data points or observations during a 24-hour period of operation, and a very large data set over the twelve-month period.

Figure 7:
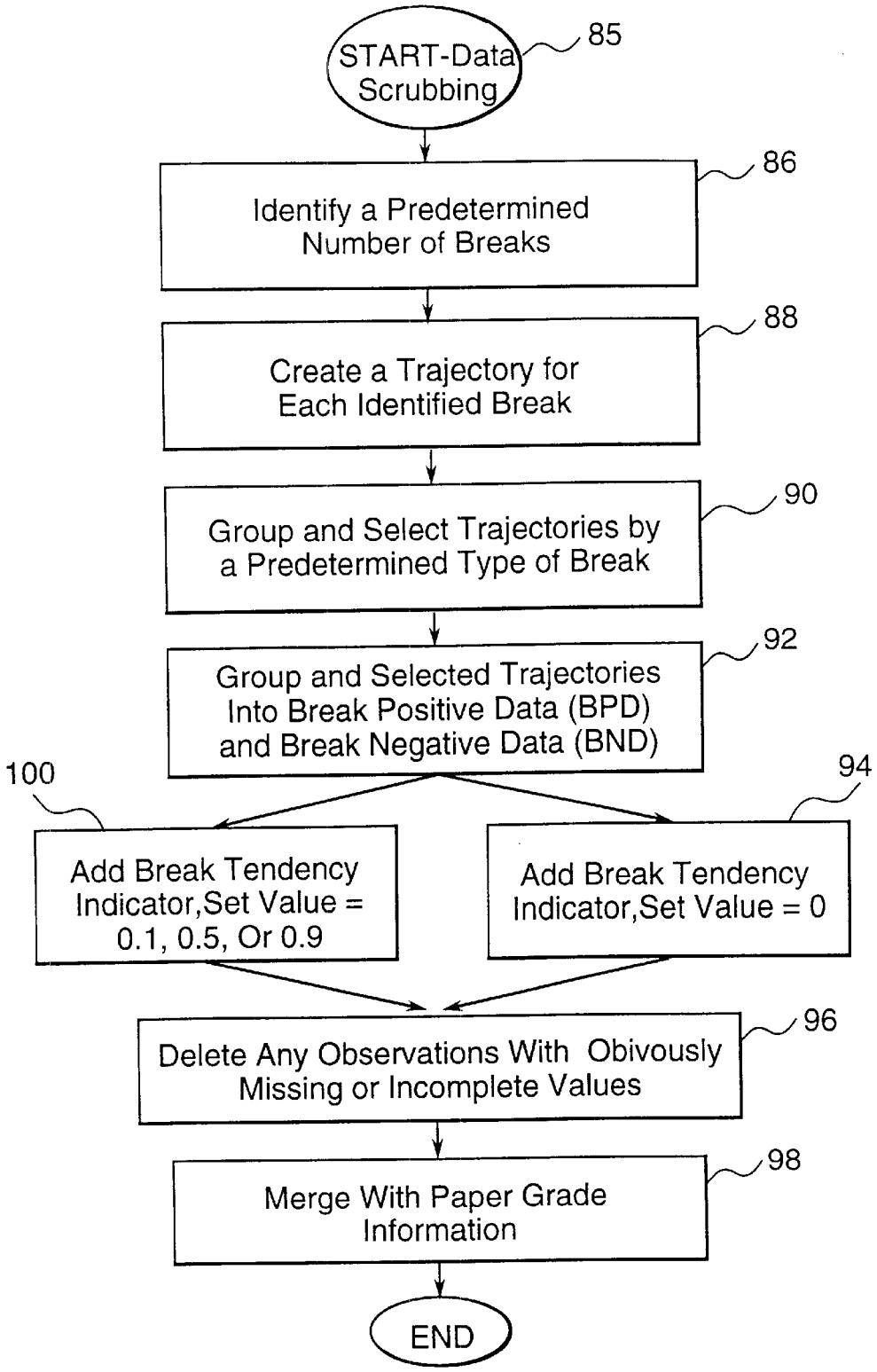
FIG. 7 is a flow chart setting forth the steps used in this invention to perform data scrubbing on the acquired historical data.

Referring to FIG. 7, for example, the data scrubbing portion of the data reduction involves grouping the data according to various break trajectories. A break trajectory is defined as a multivariate time-series starting at a normal operating condition and ending at a wet-end break. For example, a long break trajectory could last up to a couple of days, while a short break trajectory could be less than three hours long.

A predetermined number of web breaks are identified at 86. In the preferred embodiment, all of the web breaks are identified, although a smaller sample size may be used. For each web break, a trajectory of data is created over a predetermined window at 88. In the preferred embodiment, the trajectory of data is created in a 60-minute window ending with the break. These trajectories are grouped by a predetermined type of break, and one of the groups may be selected for further processing at 90. For example, in the preferred embodiment there are four major groups of breaks, however, only breaks corresponding to situations defined as "Unknown Causes" were evaluated. The other major groups include breaks with known causes, which are less suitable for predictive modeling. As a result, data relating to the known causes groups are taken out of the analysis. Thus, for example, the historical data can be reduced to 433 break trajectories, containing 443,273 observations and 46 variables.

Once the data relating to a selected group of trajectories, such as unknown causes, is defined, the selected break trajectory data is divided into a predetermined number of groups at 92. For example, the data may be divided into two groups to distinguish data associated with an imminent break from data associated with a stable operation. One skilled in the art will realize, however, that the data may be grouped in numerous other gradations in relation to the break. Utilizing two groups, the first group contains the set of observations taken within a predetermined pre-break to break time window, such as 60 minutes prior to the break to the moment of the break. This data set is denoted as break positive data and, in the preferred embodiment, contains 199,377 observations and 46 variables. The remaining data set, containing the set of observations greater than 60 minutes prior to the break, is denoted as break negative data. In the preferred embodiment, the break negative data contains 243,896 observations and 46 variables. The data collected after the moment of the break is discarded, since it is already known that the web has broken.

In the break negative data, a break tendency indicator variable is added to the data and assigned a value of 0 at 94. The break indicator value of 0 denotes that a break did not occur within the data set. Further, any incomplete observations and obviously missing values are deleted at 96. Additionally, the break negative data is merged with data representing a paper grade variable at 98. For example, in a preferred embodiment, this yields a final set of break negative data containing 233,626 observations and 47 variables.

In the break positive data, a predetermined break sensitivity indicator variable is added to the data at 100. For example, using the 60 minute pre-break to break time window, the break sensitivity indicator is assigned a value of 0.1, 0.5 or 0.9, respectively, corresponding to the first, middle or last 20 minutes of the break trajectory. These break sensitivity indicator values represent a low, medium and high break possibility, respectively. As one skilled in the art will realize, the number and value of the break sensitivity indicators may vary based on the application. Further, any incomplete observations and obviously missing values are deleted at 96. Also, only the first data point corresponding to the break is included in the data set for each break trajectory. This allows each break trajectory data set to only include relevant data prior to the break. Additionally, the break positive data is merged with data representing a paper grade variable at 98. For example, this yields a final set of break positive data containing 26,453 observations and 47 variables. Thus, by performing data scrubbing, two data sets—break positive data and break negative data—are created and are used throughout the remainder of the process.

As one skilled in the art will realize, some of the common steps outlined above, such as deleting observations and merging paper grade information, may be performed in any order and prior to dividing the data sets into break positive and break negative data.

Figure 8:
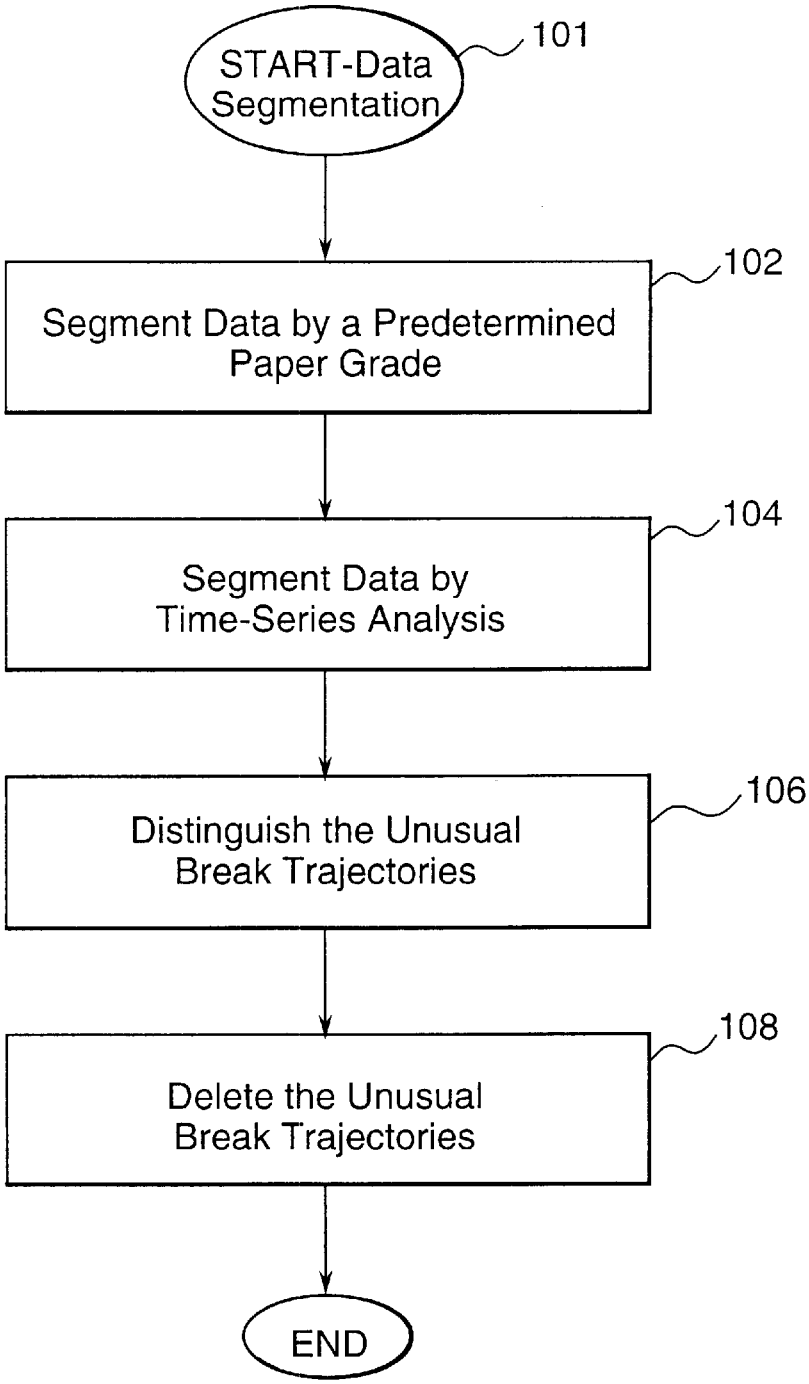
FIG. 8 is a flow chart setting forth the steps used in this invention to perform data segmentation on the acquired historical data.

After the data scrubbing 85, a data segmentation 101 is performed. Referring to FIG. 8, both the break positive and break negative data are segmented according to paper grade at 102, since different grades of paper may exhibit different break characteristics. In the preferred embodiment, for example, a paper grade denoted as RSV656 is selected and the break positive data originally containing 443 break trajectories and 26,453 observations (representing numerous paper grades) are segmented into 131 break trajectories and 7,348 observations relating to the RSV656 paper grade. Similarly, the break negative data containing 233,626 observations are segmented to 59,923 observations relating to the RSV656 paper grade.

The break positive data are preferably further segmented by time-series analysis at 104. Because each break trajectory is a multivariate time-series containing a large amount of data, it is preferred to summarize each break trajectory by a single number to aid in the segmentation process. Before this analysis, however, a preliminary variable selection may be performed, including knowledge engineering, visualization and CART. As one skilled in the art will realize, the segmentation by time-series analysis and variable selection may be performed in any order. The variable selection process is described below in more detail. Although all of the sensor readings could be used, in the preferred embodiment only 31 variables (out of 43 sensor readings) are needed to distinguish the unusual trajectories. The unusual trajectories, which represent "outlier" trajectories that are significantly different than the majority of trajectories, are distinguished from the data set at 106 as a result of the time-series segmentation process. The following is a description of the algorithm for a preferred time-series segmentation process.

For each break trajectory

- For each sensor
  - Build an autoregressive model—AR(1)—from the readings.
- End of "for" loop.
- (At this point, there are 31 AR(1) models; hence 31 corresponding coefficients).
- Compute the geometric mean of the 31 AR(1) coefficients.

End of "for" loop.

Figure 9:
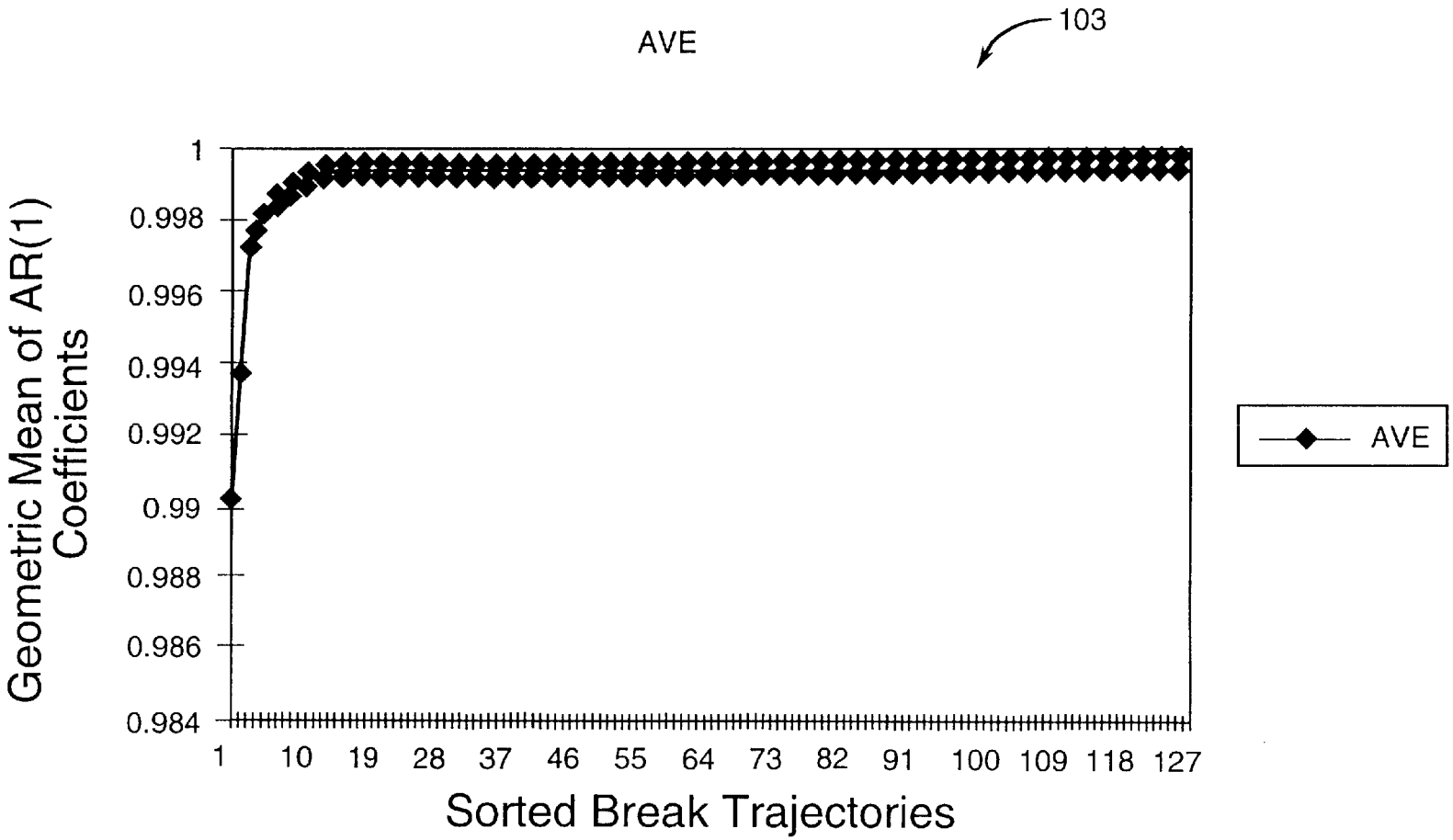
FIG. 9 is a graph for one preferred embodiment of the segmentation of the break positive data by time-series.

The autoregressive model for each sensor reading is of order 1 according to the following equation: $x(t)=\alpha x(t-1)+\epsilon$; where x(t)=the sensor reading indexed by time; $\alpha$=a coefficient relating the current sensor reading to the sensor reading from the previous time step; x(t−1)=the sensor reading from the previous time step; and $\epsilon$=an error term. The idea is to summarize each multivariate time-series by a single number, which is the geometric mean of the individual univariate time-series of the break trajectory. Referring to FIG. 9, the geometric mean of AR(1) coefficients 103 from a representative plurality of break trajectories are shown in graphical form.

Once the break trajectories are summarized by a single number, they may be segmented into a predetermined number of groups in order to aid in modeling. For example, in a preferred embodiment, the break trajectories are divided into two groups. Referring to FIG. 9, one group consists of the first 11 break trajectories (the curved portion of the line) while the other group comprises the rest of the break trajectories. As one skilled in the art will realize, the number of predetermined groups and the point of division of the groups is a subjective decision that may vary from one data set to the next. In the preferred embodiment, for example, the first 11 break trajectories are all very fragmented They correspond to an "avalanche of breaks," e.g., trajectories occurring one after another having lengths much shorter than 60 minutes (the one-hour time window that immediately follows a break), and therefore these unusual trajectories are removed from the data set used for model building at 108. Thus, for example, the data segmentation results in the break positive data for the RSV656 paper grade having 120 break trajectories and 6,999 observations.

Once the data reduction 76 (FIG. 6) has been completed, then a variable reduction process 78 (FIG. 6) is initiated to derive the simplest possible model to explain the past (training mode) and predict the future (testing mode). Typically, the complexity of a model increases in a nonlinear way with the number of inputs used by the model. High complexity models tend to be excellent in training mode, but rather brittle in testing mode. Usually, these high complexity models tend to overfit the training data and do not generalize well to new situations—referred to as "lack of model robustness." There is a modeling bias in favor of smaller models, thereby trading the potential ability to discover better fitting models in exchange for protection from overfitting. From the implementation point of view, the risk of more variables in the model is not limited to the danger of overfitting. It also involves the risk of more sensors malfunctioning and misleading the model predictions. In an academic setting, the risk/return tradeoff may be more tilted toward risk taking for higher potential accuracy in predicting future outcomes. Therefore, a reduction in the number of variables and its associated reduction of inputs is desired to derive simpler, more robust models.

Further, in the presence of noise it is desirable to use as few variables as possible, while predicting well. This is often referred to as the "principle of parsimonious." There may be combinations (linear or nonlinear) of variables that are actually irrelevant to the underlying process, that due to noise in data appear to increase the prediction accuracy. The idea is to use combinations of various techniques to select the variables with the greater discrimination power in break prediction.

Figure 10:
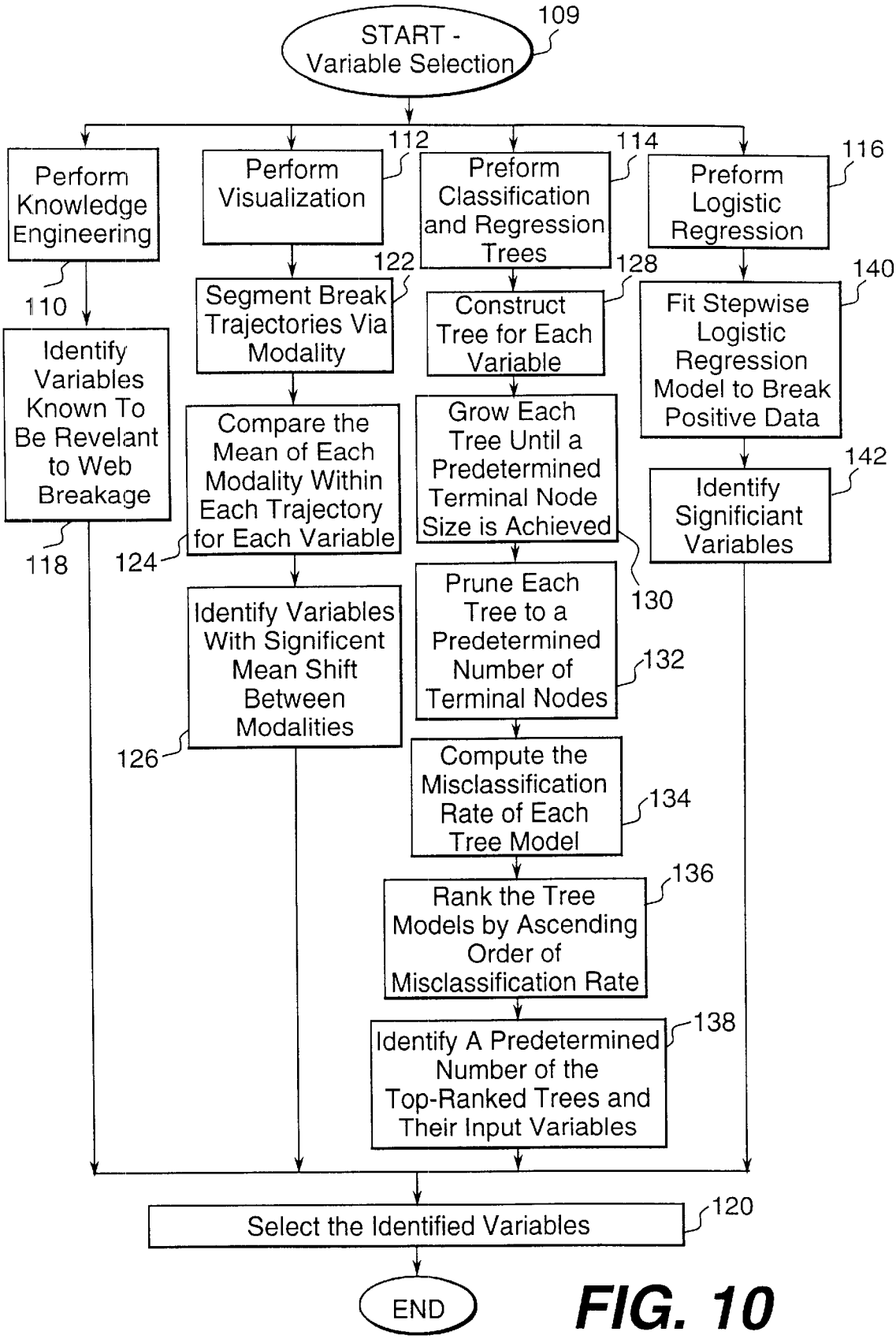
FIG. 10 is a flow chart setting forth the steps used in this invention to perform variable selection on the acquired historical data.

The variable reduction activity is subdivided into two steps, variable selection 109 and principal component analysis (PCA) 143, which are described below. Referring to FIG. 10, a number of techniques may be used for variable selection. They include performing knowledge engineering at 110, visualization at 112, CART at 114, logistic regression at 116, and other similar techniques. These techniques may be used individually, or preferably in combination, to select variables having greater discrimination power in predicting web breakage.

In the preferred embodiment, for example, by utilizing knowledge engineering all of the sensors relating to variables corresponding to paper stickiness and paper strength are identified at 118. In the preferred embodiment, it has been determined that paper stickiness and paper strength are important variables that affect web breakage. This results in selecting 16 sensors and their associated variables at 120.

Figure 11:
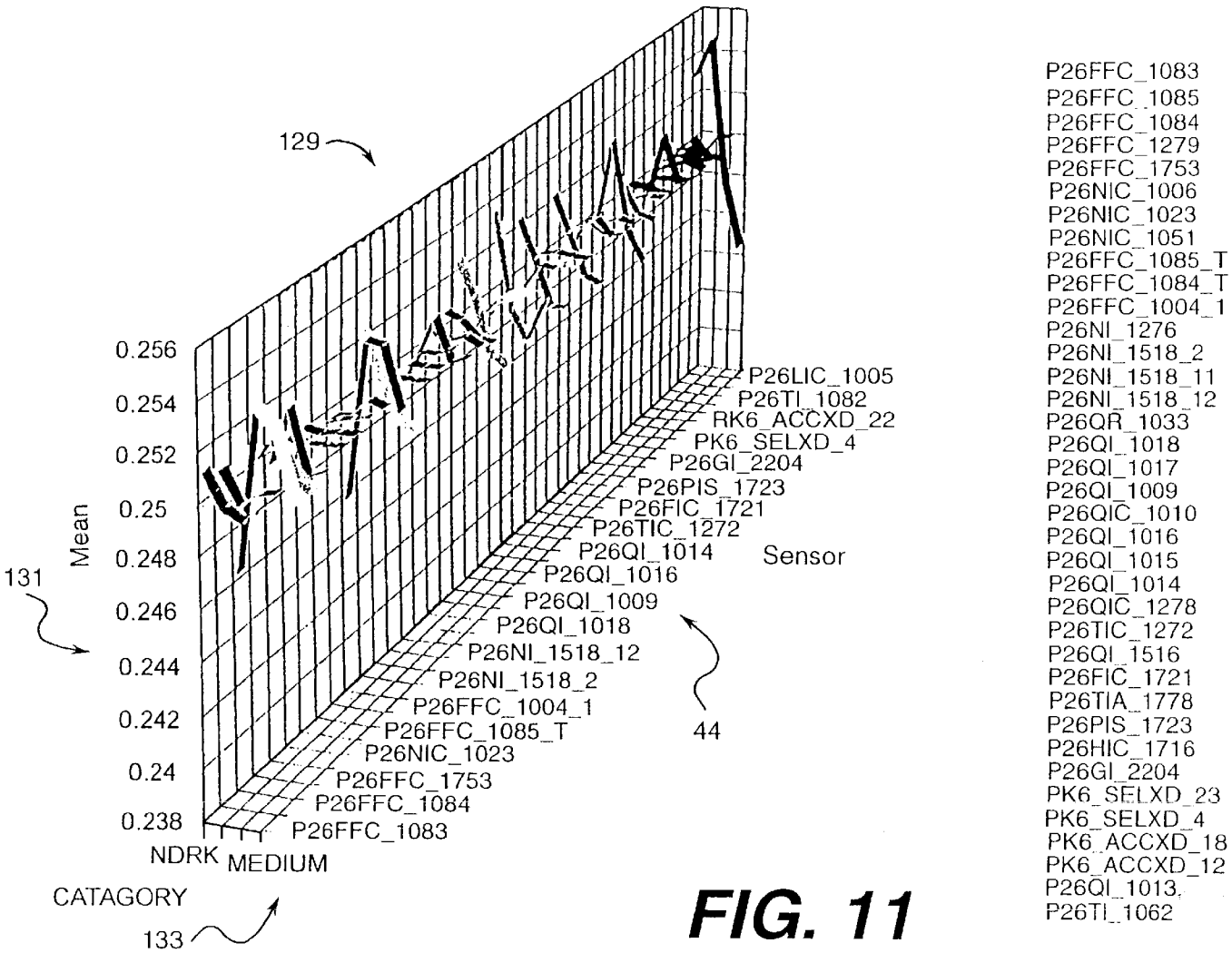
FIG. 11 is a graph for one preferred embodiment of variable selection by visualization of mean shift.

Visualization, for example, includes segmenting the break trajectories at 122 into four groups or modalities: break negative, break positive (low), break positive (medium) and break positive (high). The modalities of the break positive data correspond to the break tendency indicator variable of 0.1, 0.5 and 0.9 discussed above. A comparison of the mean of each modality within each break trajectory is performed for each variable at 124. As a result, variables having significant mean shifts between modalities are identified and selected at 126 and 120. In the preferred embodiment, referring to FIG. 11, the visualization technique 129 plots the mean 131 for each sensor 44 by modality 133, resulting in selecting another eight sensors.

Further, in the preferred embodiment, another five sensors are added utilizing classification and regression trees (CART). CART is used for variable selection as follows. Assume there are N input variables (the sensor readings) and one output variable (the web break status, i.e. break or non-break). The following is an algorithm describing the variable selection process:

- For each input variable:
  - Construct a tree model with the single input variable and the output variable at 128.
  - Let the tree grow until the size of each terminal node is no smaller than about 1/100 of the original data set at 130.
  - Prune the tree until the number of terminal nodes is around 10 at 132.
  - Compute the misclassification rate, which is the sum of the number of false positives and false negatives, of the tree model at 134.
- End of "for" loop.
- (At this point, there are N tree models. Each tree has around 1 0 terminal nodes.)
- Rank the N tree models by ascending order of their misclassification rates at 136.
- Select the top 20 trees and their input variables at 138.

The basic idea is to use the misclassification rate as a measure of the discrimination power of each input variable, given the same size of tree for each input variable. As one skilled in the art will realize, the size of the tree, the pruning of the tree and selection of the top trees all include a predetermined number that may vary between applications, and this invention is not limited to the above-mentioned predetermined numbers. As a result of CART, five more variables not previously identified are selected at 120, making a total of 29 variables. As mentioned before, these 29 variables are used for time-series analysis based segmentation at 101 (FIGS. 6 and 8).

Another method to identify web break discriminating variables is logistic regression. For example, a stepwise logistic regression model may be fitted to the break positive data at 140. As a result, significant variables may be identified at 142 by examining variables included in the final logistic regression models. One skilled in the art will realize that other types of variable classification techniques may be utilized, such as multivariate adaptive regression splines ("MARS") and neural networks ("NN"). In the preferred embodiment, utilizing logistic regression results in a model that identifies two significant variables—"broke to broke screen" and "headbox ash consistency." Therefore, these variables are selected at 120 and the total number of variables is 31. A list of sensors and variable selection methods, in one preferred embodiment, are set forth below in Table 1.

TABLE 1

Summary of variable selection.

| Variable ID | Sensor ID | Meaning | GE-17 | Visualization | CART | Logistic Regression | Dropped | REASON TO DROP |
|---|---|---|---|---|---|---|---|---|
| s1 | P26FFC_1083 | TMP feed, flow | ✓ | | | | | |
| s2 | P26FFC_1085 | Chemical pulp feed | ✓ | | | | | |
| s3 | P26FFC_1084 | Broke feed | ✓ | | | | | |
| s4 | P26FIC_1279 | Filler to centrifugal cleaner pump | ✓ | | | | | |
| s5 | P26FFC_1753 | Clay flow | | ✓ | | | | |
| s6 | P26NIC_1051 | Broke to broke screen | | | | ✓ | | |
| s7 | P26FFC_1084_T | Broke percentage | | ✓ | | | | |
| s8 | P26FFC_1004_1 | Bleached TMP percentage | ✓ | | | | | |
| s9 | P26NI_1518_11 | Total retention | ✓ | | | | | |
| s10 | P26NI_1518_12 | Ash retention | ✓ | | | | | |
| s11 | P26QR_1033 | Chemical pulp freeness | ✓ | | | | | |
| s12 | P26QI_1018 | Chemical pulp pH | | | ✓ | | | |
| s13 | P26QI_1017 | Chemical pulp conductivity | | ✓ | | | | |
| s14 | P26QI_1016 | TMP conductivity | | ✓ | | | | |
| s15 | P26QI_1014 | Broke conductivity | | ✓ | | | | |
| s16 | P26QIC_1278 | Wire water pH | ✓ | | | | | |
| s17 | P26TIC_1272 | Wire pit temperature | ✓ | | | | | |
| s18 | P26QI_1516 | Headbox conductivity | ✓ | | | | | |
| s19 | P26FIC_1721 | Retention aid flow | ✓ | | | | | |
| s20 | P26TIA_1778 | Retention aid/dilution tank | | | ✓ | | | |
| s21 | P26HIC_1716 | Foam inhibitor flow to wair pits | | ✓ | | | | |
| s22 | P26GI_2204 | Slice lip position | ✓ | | | | | |
| s23 | PK6_SELXD_4 | Wire section speed | ✓ | | | | | |
| s24 | PK6_ACCXD_18 | Ash content | ✓ | | | | | |
| s25 | PK6_ACCXD_22 | K-moisture | ✓ | | | | | |
| s26 | P26QI_1013 | White water pH | | | ✓ | | | |
| s27 | P26TI_1062 | White water tower temperature | | | ✓ | | | |
| s28 | P26LIC_1005 | TMP proportioning chest | | | ✓ | | | |
| s29 | P26QIC_1240 | Air content (conrex) | | ✓ | | | | |
| s30 | P26NI_1518_2 | Headbox ash consistency | | | | ✓ | | |
| s31 | P26QI_1015 | Broke pH | | ✓ | | | | |
| s32 | P26FFC_1752 | Caoline flow | | | | | X | 2 |
| s33 | P26NIC_1006 | TMP feed, consistency | | | | | X | 3, 4 |
| s34 | P26NIC_1023 | Chemical pulp FEED, consistency | | | | | X | 3, 4 |
| s35 | P26FFC_1085_T | Chemical pulp percentage | | | | | X | 3, 4 |
| s36 | P26NI_1276 | Machine pulp | | | | | X | 3, 4 |
| s37 | P26QI_1009 | TMP 1 tower pH | | | | | X | 3, 4 |
| s38 | P26QIC_1010 | TMP 2 tower pH | | | | | X | 3, 4 |
| s39 | P26PIS_1723 | retention aid pipe pressure before screens | | | | | X | 2 |
| s40 | P26FI_0221_1 | Outer wire, wire water | | | | | X | 1 |
| s41 | PK6_SELXD_23 | Draw difference 4th press - 1st drier-section | | | | | X | 3, 4 |
| s42 | T13FFC_6068 | Alkaline feed | | | | | X | 2 |
| s43 | PK6_SELXD_22 | Draw difference 3rd–4th press | | | | | X | 3, 4 |

For example, of the 43 potential sensor readings, a total of 12 were dropped due to one or more of the reasons, corresponding to "Reason To Drop" in Table 1: 1—too many missing observations in paper grade RSV656 data; 2—too many missing observations; 3—misclassification rate is too high; and 4—the means among the low, medium and high groups are too close together.

The variables identified utilizing the variable selection techniques are then utilized for principal components analysis (PCA). PCA is concerned with explaining the variance-covariance structure through linear combinations of the original variables. PCA's general objectives are data reduction and data interpretation. Although p components are required to reproduce the total system variability, often much of this variability can be accounted for by a smaller number of the principal components (k<<p). In such a case, there is almost as much information in the first k components as there is in the original p variables. The k principal components can then replace the initial p variables, and the original data set, consisting of n measurements on p variables, is reduced to one consisting of n measurements on k principal components.

An analysis of principal components often reveals relationships that were not previously suspected and thereby allows interpretations that would not ordinarily result. Geometrically, this process corresponds to rotating the original p-dimensional space with a linear transformation, and then selecting only the first k dimensions of the new space. More specifically, the principal components transformation is a linear transformation which uses input data statistics to define a rotation of original data in such a way that the new axes are orthogonal to each other and point in the direction of decreasing order of the variances. The transformed components are totally uncorrelated.

Figure 12:
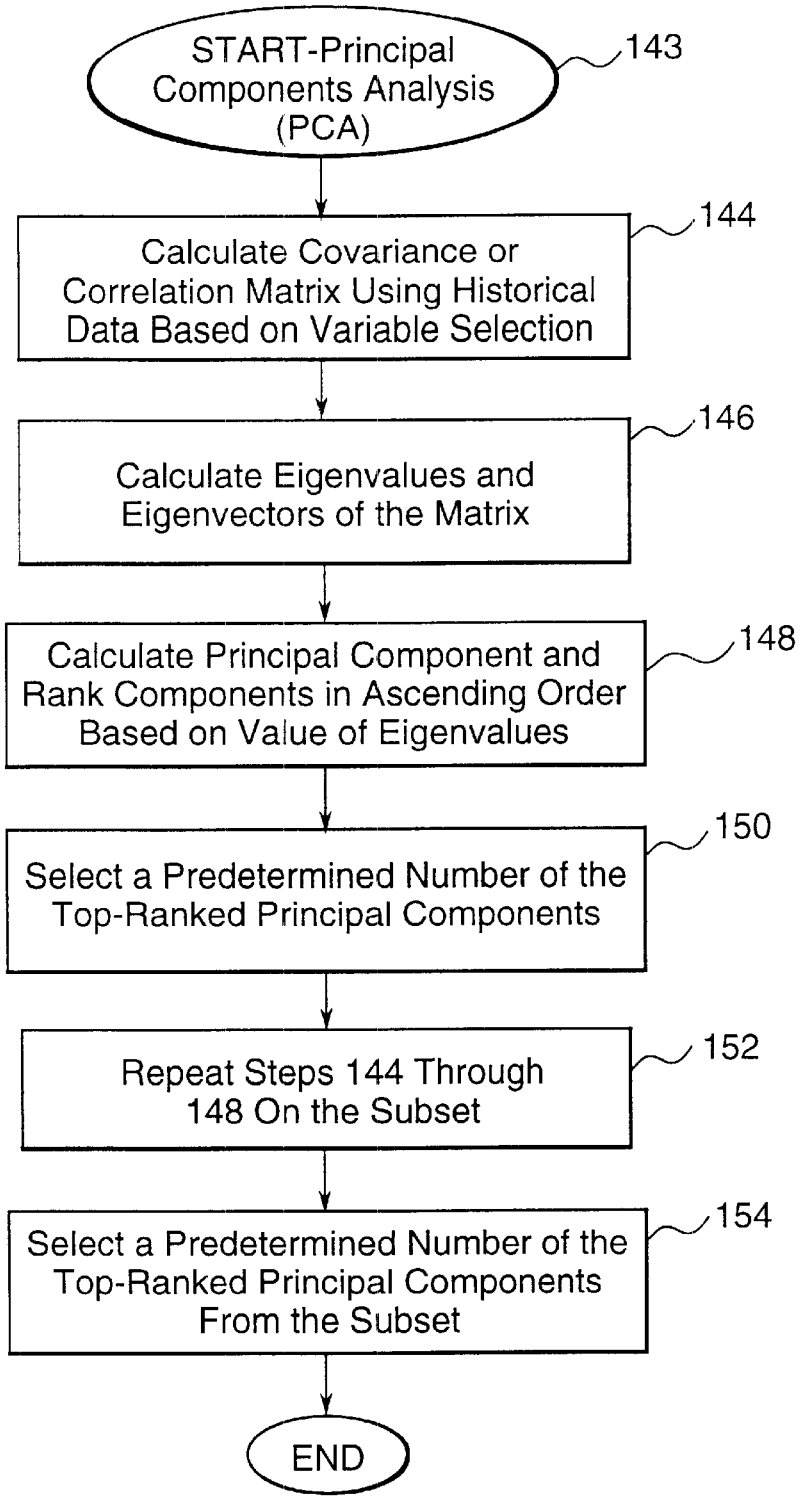
FIG. 12 is a flow chart setting forth the steps used in this invention to perform principal components analysis (PCA) on the acquired historical data.

Referring to FIG. 12, there are a number of steps in principal components transformation:

- Calculation of a covariance or correlation matrix using the selected variables data at 144.
- Calculation of the eigenvalues and eigenvectors of the matrix at 146.
- Calculation of principal components and ranking of the principal components based on eigenvalues at 148, where the eigenvalues are an indication of variability in each eigenvector direction.

In building a model, therefore, the number of variables identified by the variable selection techniques can be reduced to a predetermined number of principal components. In the preferred embodiment, the first three principal components are utilized to build the model—a reduction in dimensionality from 31 sensors to three principal components. Note that the above reduction comes from both variable selection and PCA.

In the preferred embodiment, two experiments are performed for the computation of the principal components. First, all 31 variables from the variable selection technique are utilized, including their associated break positive data, and the coefficients obtained in the PCA are identified. Then, a smaller subset of a predetermined number of variables (16 in this case) are selected at 150 by eliminating variables (15 in this case) whose coefficients were too small to be significant. Then another PCA is performed at 152 utilizing this smaller subset. This result is summarized in Table 2.

TABLE 2

Principal components analysis of 16 break positive sensors.

| Principal Components | Eigenvalue | Proportion | Cumulative |
|---|---|---|---|
| PRIN1 | 14.42 | 90.14% | 90.14% |
| PRIN2 | 0.49 | 3.07% | 93.20% |
| PRIN3 | 0.32 | 1.98% | 95.19% |
| PRIN4 | 0.25 | 1.57% | 96.76% |
| PRIN5 | 0.18 | 1.10% | 97.85% |
| PRIN6 | 0.08 | 0.51% | 98.37% |
| PRIN7 | 0.06 | 0.38% | 98.75% |
| PRIN8 | 0.05 | 0.34% | 99.09% |
| PRIN9 | 0.04 | 0.24% | 99.33% |
| PRIN10 | 0.03 | 0.22% | 99.55% |
| PRIN11 | 0.03 | 0.16% | 99.71% |
| PRIN12 | 0.02 | 0.11% | 99.82% |
| PRIN13 | 0.01 | 0.08% | 99.90% |
| PRIN14 | 0.01 | 0.05% | 99.95% |
| PRIN15 | 0.01 | 0.04% | 100.00% |
| PRIN16 | 0.00 | 0.00% | 100.00% |

From the first row of Table 2, in the preferred embodiment, the first principal component explains 90% of the total sample variance. Further, the first six principal components explain over 98% of the total sample variance. Thus, a predetermined number of the top-ranked principal components, and their associated data, are selected at 154. Consequently, in the preferred embodiment, it is determined that sample variation may be summarized by the first three principal components and that a reduction in the data from 16 variables to three principal components is reasonable. As one skilled in the art will realize, any predetermined number of principal components may be selected, depending on the number of variables desired and the amount of variance desired to be explained by the variables.

Figure 13:
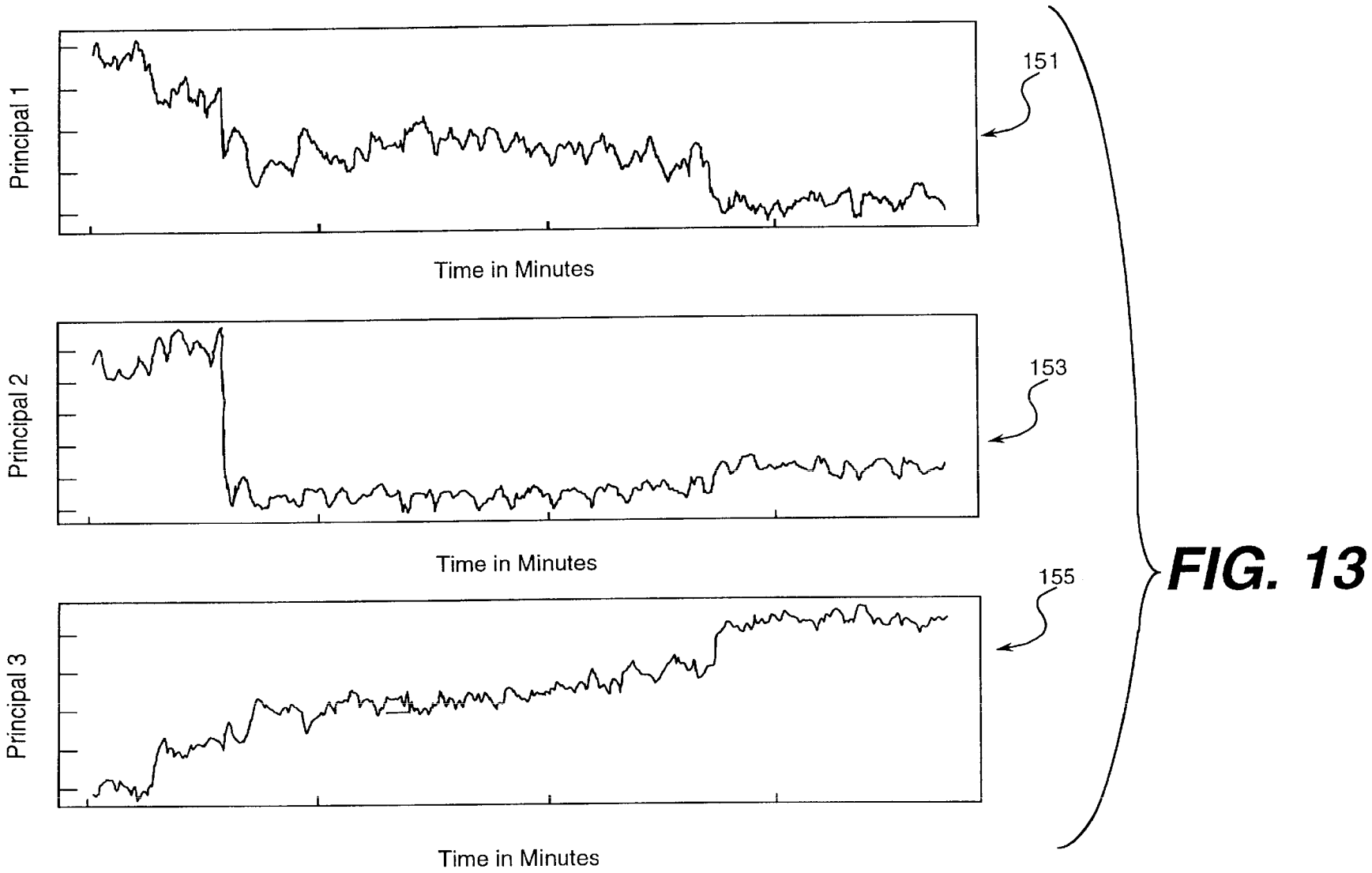
FIG. 13 is a graph for one preferred embodiment of the time-series data of the first three principal components of a representative break trajectory.

As a result of the principal component analysis, the time-series of the first three principal components for each break trajectory may be generated. FIG. 13 represents a plot of the time-series of the first three principal components 151, 153 and 155 for a representative break trajectory.

Once the principal components are identified, then value transformation techniques 80 are applied to the principal components data in order to build the predictive model. The main purpose of value transformation is to remove noise, reduce data size by compression, and smooth the resulting time-series to identify and highlight their general patterns (i.e., velocity, acceleration, etc.). This goal is achieved by using typical signal-processing algorithms, such as a median filter and a rectangular filter.

Figure 14:
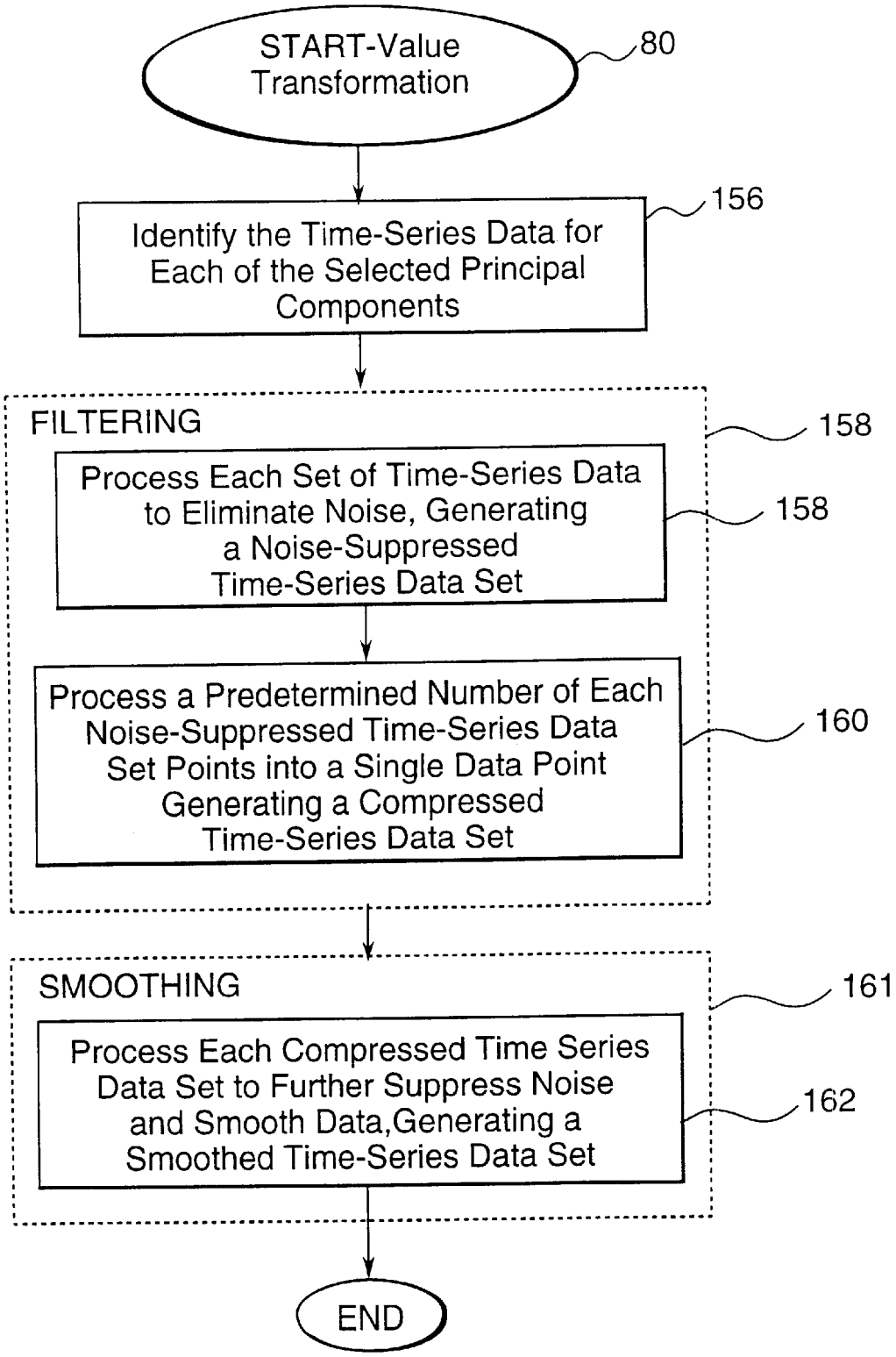
FIG. 14 is a flow chart setting forth the steps used in this invention to perform value transformation of the time-series data for the selected principal components.
Figure 15:
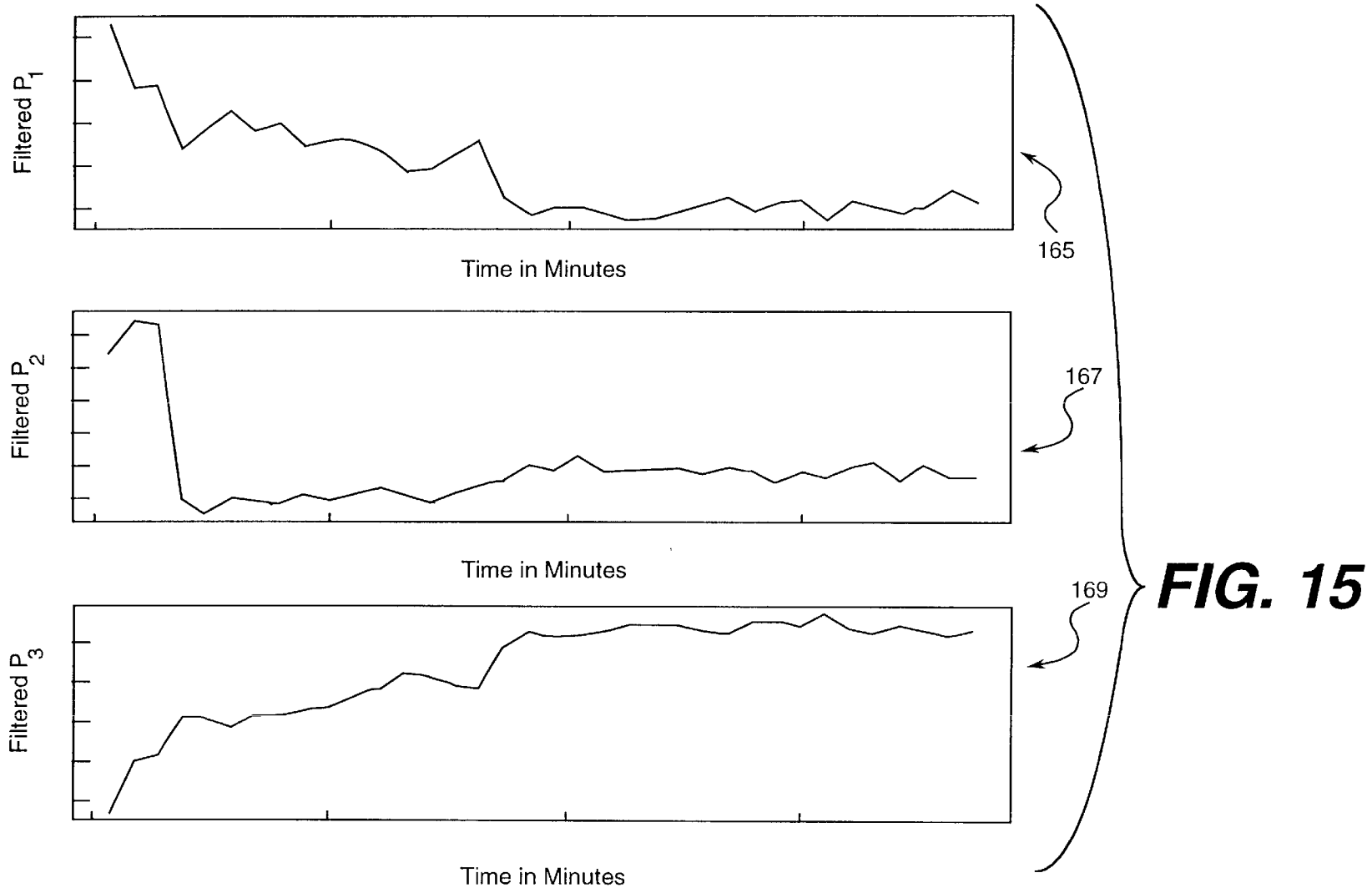
FIG. 15 is a graph for one preferred embodiment of the filtered time-series data of the first three principal components of FIG. 13.
Figure 16:
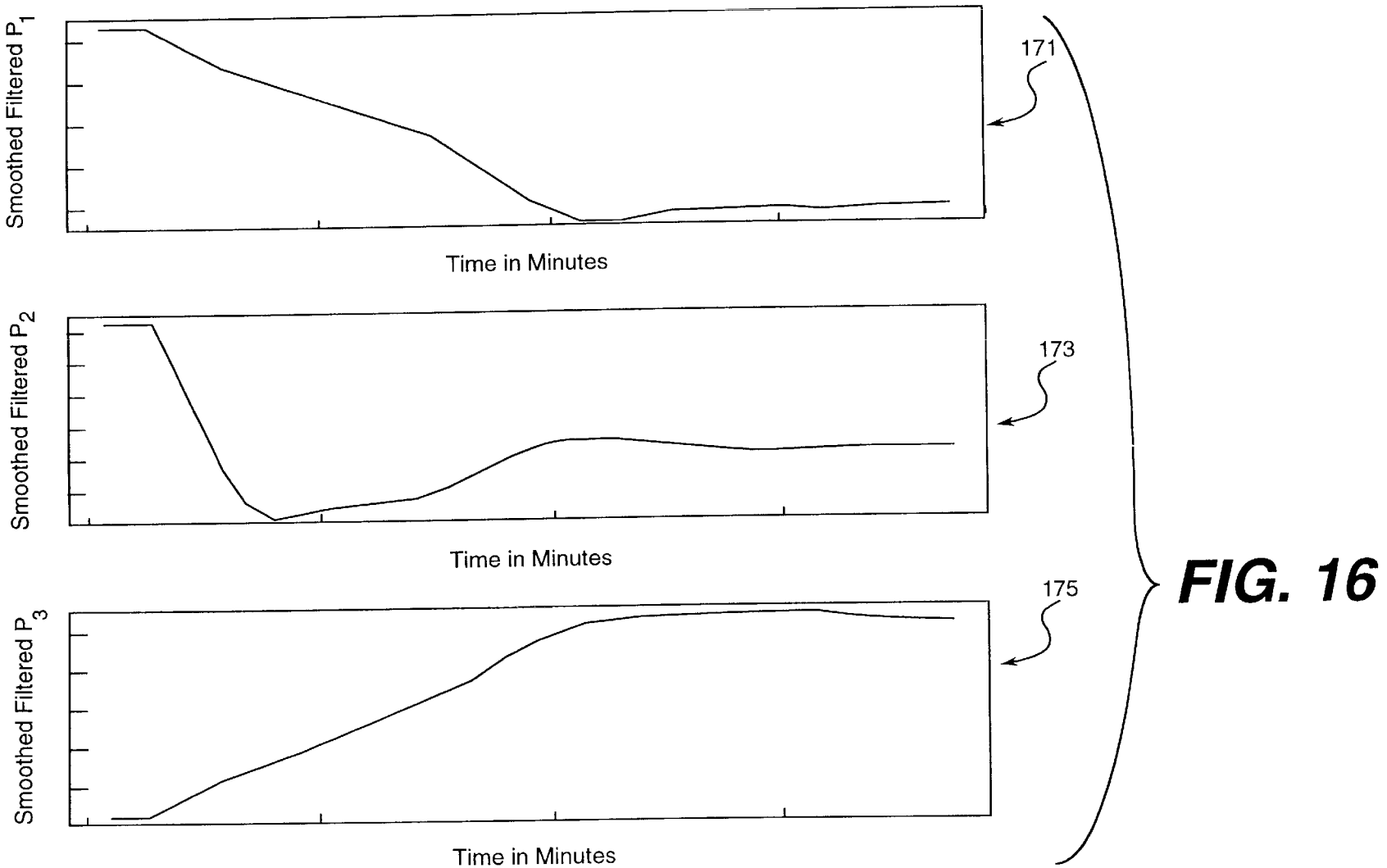
FIG. 16 is a graph for one preferred embodiment of the smoothed, filtered time-series data of the first three principal components of FIG. 15.

Referring to FIG. 14, the time-series data for each selected principal component is identified at 156. Each set of time-series data is suppressed to form a noise-suppressed time-series data set at 158. Then each noise-suppressed time-series data is compressed to form a compressed, suppressed time-series data set at 160. For example, a value transformation using a median filter serves two purposes—it filters out noises and compresses data. This results in summarizing a block of data into a single, representative point. FIG. 15 shows the filtered time-series plot of the three principal components 165, 167 and 169 of the representative break trajectory of FIG. 13. Note that the window size of the median filter is three. Further, additional filters may be applied to smooth the data to form a smoothed, compressed, suppressed time-series data set at 162. For example, a rectangular moving filter may be applied across the sequence of the three principal components in steps of one. This results in smoothing the data and canceling out sensor noises. FIG. 16 shows the smoothed, filtered time-series plot of the three principal components 171, 173 and 175 of the representative break trajectory of FIGS. 13 and 15. Note that the window size of the rectangular filter is five.

Figure 17:
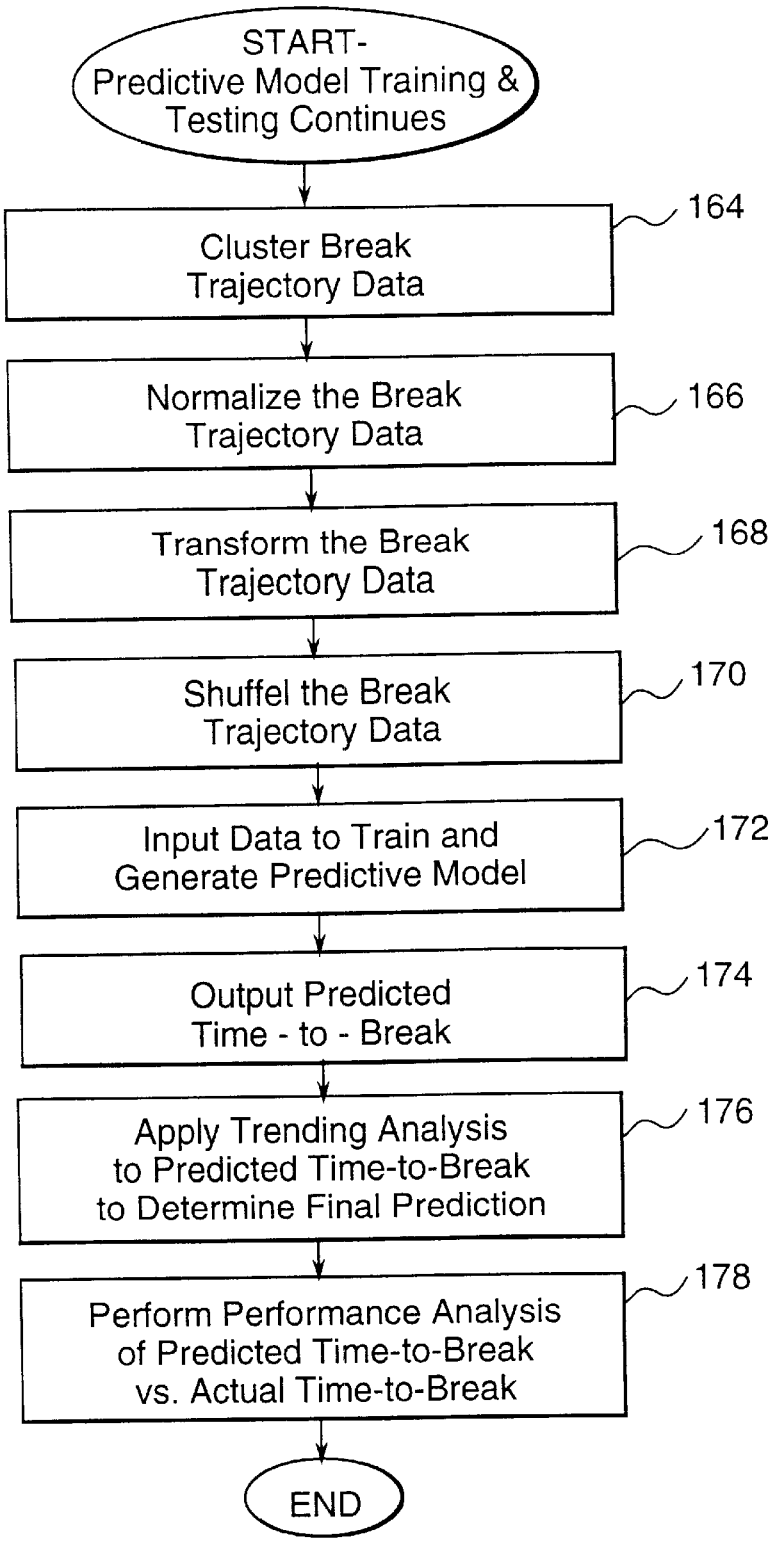
FIG. 17 is a flow chart setting forth the steps used in this invention to further prepare the data, and train and test the predictive model of the present invention.

Referring to FIG. 17, the predictive model generation, training and testing further includes grouping or clustering the principal components break trajectory data by energy content at 164 in order to determine separate predictive models. For example, one method of clustering the principal components break trajectory data is by sorting based on the mean of the first principal component. As one skilled in the art will realize, other methods of sorting the break trajectories into different modalities may be utilized, such as by taking the median of the first principal component or by utilizing a combination of mean and standard deviation. Alternatively, rather than utilizing a number of predictive models, a single model may be generated from all of the data. In the preferred embodiment, the break trajectories are clustered into three groups: a low energy group, a medium energy group and a high energy group. A list of statistics from the clustering step of the preferred embodiment are set forth below in Table 3.

TABLE 3

Representative summary statistics of the three energy groups.

| | Whole dataset | Low energy group | Mix energy group | High energy group |
|---|---|---|---|---|
| # of Trajectories | 102 | 62 | 29 | 11 |
| # of Data Points | 50,664 | 33,415 | 13,911 | 3,338 |
| Min. of 1st PCA | 2.193 | 2.193 | 2.327 | 2.581 |
| Mean of 1st PCA | 2.589 | 2.513 | 2.703 | 2.882 |
| Max. of 1st PCA | 3.508 | 2.867 | 3.508 | 3.234 |

Next, the break trajectory data of the principal components is normalized at 166. In the preferred embodiment, the data is normalized within the range of 0.1 to 0.9 to avoid saturation of the nodes on the neuro-fuzzy system input layer. The following equation may be used to normalize the data:

$$\text{normalized value} = \frac{\text{nominal value} - \text{minimum value}}{\text{maximum value} - \text{minimum value}}$$

where the minimum and maximum values are obtained across one specific field. In other words, the normalization occurs across columns of variables, as opposed to rows of data points.

The normalized data is then transformed to reduce variability at 168. In the preferred embodiment, a natural logarithm transformation is applied to the normalized data. One skilled in the art will realize, however, that other variability reducing transformations may be utilized, such as different basis of log or logistic functions.

Next, the data is then shuffled at 170. Through shuffling, the data is randomly permuted across all patterns. In other words, the permutation is effected across rows of data points within each modality or energy group. This enhances the ability of the neuro-fuzzy system to learn the underlying function of mapping the input states, obtained from the sensor readings, to the desired output (time-to-break prediction) in a static way, as opposed to a dynamic way that involves time changes of these values. This results in reduced complexity and computational requirements for the system.

Figure 18:
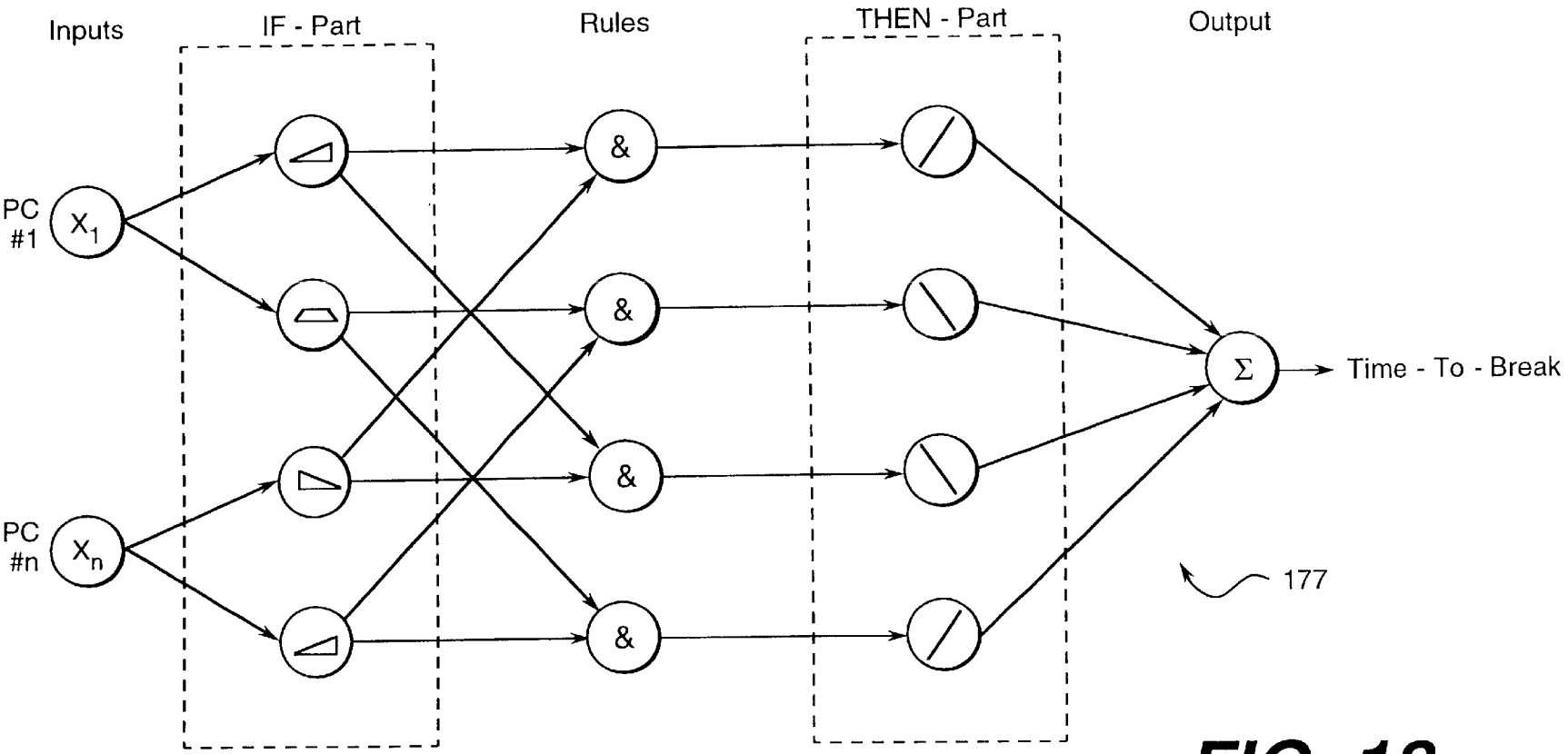
FIG. 18 is a schematic representation of a neuro-fuzzy system used in accordance with this invention.

The data is then input into a neuro-fuzzy system in order to generate the predictive models at 172. As one skilled in the art will realize, the steps 166, 168 and 170 may be performed in any order. Further, some of these steps may be skipped, such as the normalization or log transformation, depending on the desired accuracy of the final prediction. The preferred neuro-fuzzy system is a network-based implementation of fuzzy inference, called Adaptive Network-based Fuzzy Inference System ("ANFIS"). Referring to FIG. 18, the preferred ANFIS model 177 implements the fuzzy system as a five-layer neural network so that the structure of the net can be interpreted in terms of high-level fuzzy rules. This network is then trained automatically from the data. In the system, ANFIS takes as input the paper machine variables, specifically the values of the principal components, then gives as output the predicted time-to-break for the paper web at 174 (FIG. 17).

As the data points in the training set are presented, the ANFIS model attempts to minimize the mean squared error between the network output, or predicted time-to-break, and the targeted answer, or actual time-to-break. The training method proceeds as follows:

For each pair of training patterns (input and targeted output) do
- Present inputs to ANFIS and compute the output.
- Compute the error between ANFIS's output and the targeted output.
- Keep the IF-part parameters fixed, solve for the optimal values of the THEN-part parameters using a recursive Kalman filter method.
- Compute the effect of the IF-part parameters on the error and feed it back.
- Adjust the IF-part parameters based on the feedback error using a gradient descent technique.

End of "for" loop

Repeat until the error is sufficiently small.

For prediction purposes, in the preferred embodiment, only the data in the last three hours prior to a break was utilized. Recall that the median filter has a window size of 3. Therefore, each break trajectory is modeled with 60 data points at most.

For example, with the high energy group there were 552 (less than 11 break trajectories×60 data points=660 due to incomplete break trajectories) data points for ANFIS modeling. Of the available data, 400 data points were used for training and 152 for testing. In the preferred embodiment, the ANFIS has three inputs—the first three principal components. Each input has two generalized bell-shaped membership functions (MF). Thus, there are 50 modifiable parameters for the specific ANFIS structure. The training of ANFIS stopped after 100 epochs and the corresponding training and testing root mean squared error (RMSE) were 0.1063 and 0.1209, respectively. The RMSE is defined as follows:

$$RMSE = \sqrt{\frac{\sum_{i=1}^{n}(Y_i - \hat{Y}_i)^2}{n}}$$

where Y and $\hat{Y}$ are the actual and predicted responses, respectively, and n is the total number of predictions. Table 4 summarizes ANFIS training for the three energy groups.

TABLE 4

Summary of ANFIS training for the three energy groups.

| | Low energy group | Mix energy group | High energy group |
|---|---|---|---|
| # of trajectories | 62 | 29 | 11 |
| # of total data | 3,566 | 1,609 | 552 |
| # of training data | 2,566 | 1,209 | 400 |
| # of testing data | 1,000 | 400 | 152 |
| # of inputs | 3 | 3 | 3 |
| # of MFs | 4 | 3 | 2 |
| Type of MF | Generalized bell-shaped | Generalized bell-shaped | Generalized bell-shaped |
| # of modifiable parameters | 292 | 135 | 50 |
| # of epochs | 25 | 25 | 100 |
| Training RMSE | 0.0988 | 0.0965 | 0.1063 |
| Testing RMSE | 0.1025 | 0.1156 | 0.1209 |

Referring again to FIG. 17, the predicted time-to-break is processed using a trend analysis at 176. The trend analysis takes advantage of the correlation between consecutive time-to-breaks points. For example, the time interval between two consecutive time-to-breaks points is 3 minutes. If one data point represents 9 minutes to break, the next data point in time should represent 6 minutes to break and the next data points represents 3 minutes to break, etc. Therefore, the slope of the line that connects all these time-to-break points should be one (assuming that the x-axis and the y-axis are time and time-to-break, respectively). The same theory can be applied to the predicted value of time-to-break. That is, the slope of an imaginary line that connects predicted time-to-breaks should be close to one, given a perfect predictor. This line connecting the predicted time-to-break points is denoted as the prediction line.

In the real world, it is unlikely that the prediction would ever be perfect due to noises, faulty sensors, etc. Hence, it is unlikely that the prediction line would have a slope of one. Nevertheless, in the present invention the slope of the prediction line approaches one by recursively throwing out the "outlier" data points—those predictive data points that are far away from the prediction line—and recursively re-estimating the slope of the prediction line.

Even more importantly, the predictions will be inconsistent when the "open-loop" assumption is violated. An abrupt change in the slope indicates a strongly inconsistent prediction. These inconsistencies can be caused, among other things, by a control action applied to correct a perceived problem. The present invention is interested in predicting the time-to-break in an open-loop process, where no control action is taken. However, the data are collected in a closed-loop process, where the paper machine is controlled by the operators. Therefore, the invention needs to be able to detect when the application of control actions—which are not recorded in the data—have changed the trend of the break trajectory. In such case, the predictive model of the present invention suspends the current prediction and reset the prediction history. This step eliminates many false positives.

For example, a moving window of a predetermined size, such as ten, may be utilized. Then, the slope and the intercept of the prediction line is estimated by least mean squares. After that, a predetermined number of outliers to the line, such as 2 to 4 or preferably 3, are dropped. Then, the slope and intercept of the prediction line are re-estimated with the remaining data points, which in this example are seven data points. The window is advanced in time and the above slope and intercept estimation process is repeated. As a result, two time-series of slopes and intercepts are obtained.

Then, two consecutive slopes are compared to see how far away they are from one, which would be a perfect prediction. If they are within a pre-specified tolerance band, e.g. 0.1, then the average of the two intercepts is utilized as the predicted time-to-break. Otherwise, a calculation is performed to obtain a modified average of the two consecutive slopes and intercepts to readjust these estimates. In this way, the prediction is continuously adjusted according to the slope and intercept estimation.

Figure 19:
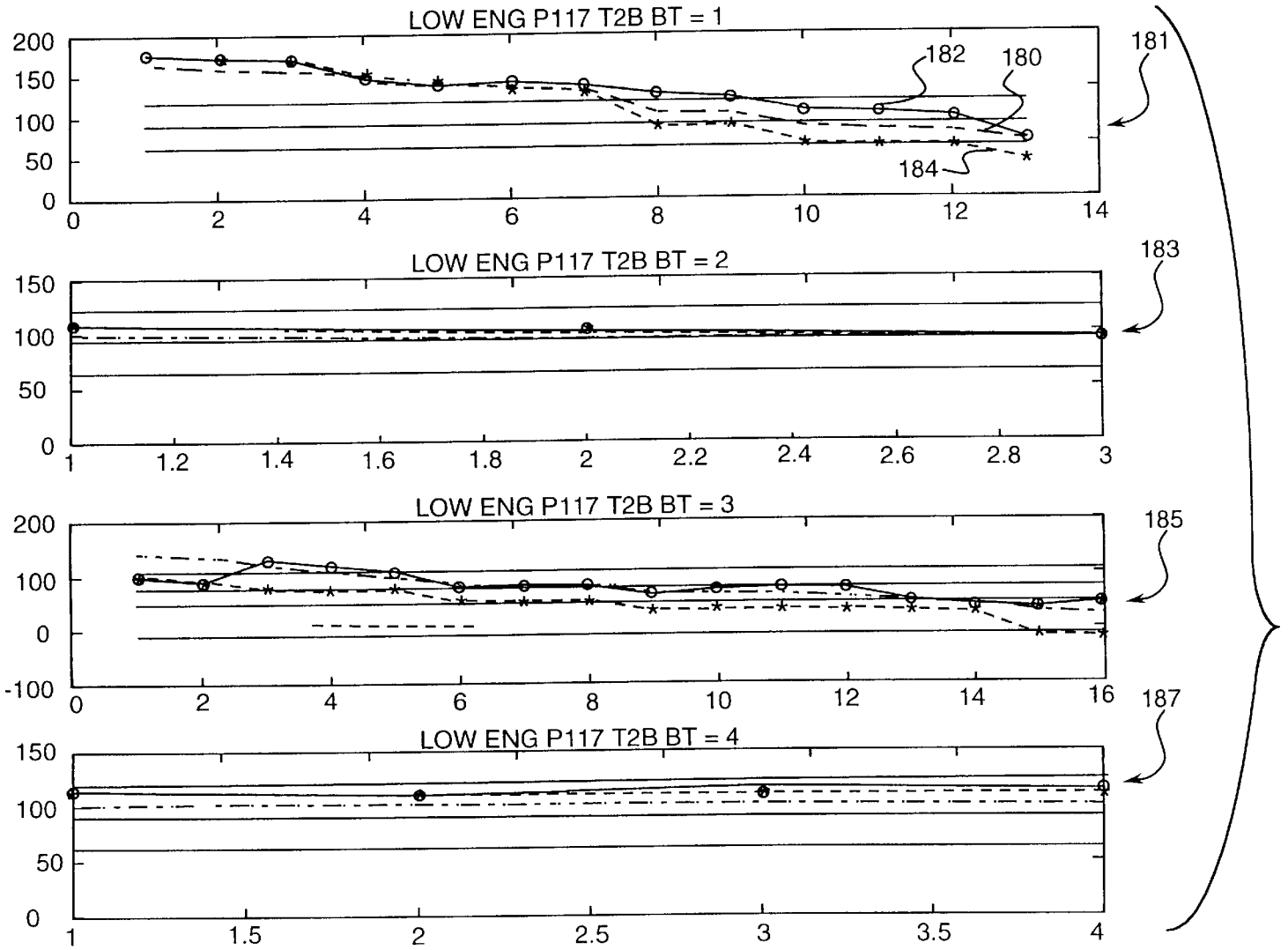
FIG. 19 is a set of graphs of actual time-to-break, time-to-break prediction, and moving average time-to-break prediction of four representative break trajectories.

FIG. 19 shows the prediction results of four typical break trajectories 181, 183, 185 and 187 from the low energy group. In the figure, the x-axis and y-axis represent prediction points and time-to-break in minutes, respectively. The dashed line 180 represents the target or actual time-to-break, while the circle points 182 and the star points 184 represent the time-to-break point prediction and the moving average of the point prediction, respectively. The final prediction is an (equally) weighted average of the point prediction (typically overestimating the target) with the moving average (typically underestimating the target).

A performance analysis comparing predicted versus actual time-to-break is performed at 178 (FIG. 17). The Root Mean Squared Error (RMSE), defined above, is a typical average measure of the modeling error. However, the RMSE does not have an intuitive interpretation that may be used to judge the relative merits of the model. Therefore, additional performance metrics may be used in the evaluation of the time-to-break predictor. In the preferred embodiment, and referring to FIGS. 20–22, the following metrics are utilized:

Distribution of false predictions 191: E(60)

False positives are predictions that were made too early (i.e., more than 40 minutes early). Therefore, time-to-break predictions of more than 100 minutes (at time=60) fall into this category. False negatives are missing predictions or predictions that were made too late (i.e., more than 20 minutes late). Therefore, time-to-break predictions of less than 40 minutes (at time=60) fall into this category Distribution of prediction accuracy 193: RMSE Prediction accuracy is defined as the root mean squared error (RMSE) for a break trajectory.

Distribution of error in the final prediction 195: E(0)

The final prediction by the model is generally associated with high confidence and better accuracy. The final prediction is associated with the prediction error at break time, i.e., E(0).

Distribution of the earliest non false positive prediction 197

The first prediction by the predictor is generally associated with high sensitivity.

Distribution of the maximum absolute deviance in prediction 199

This is the equivalent to the worst-case scenario. It shows the histogram of the maximum error by the predictor.

Figure 20:
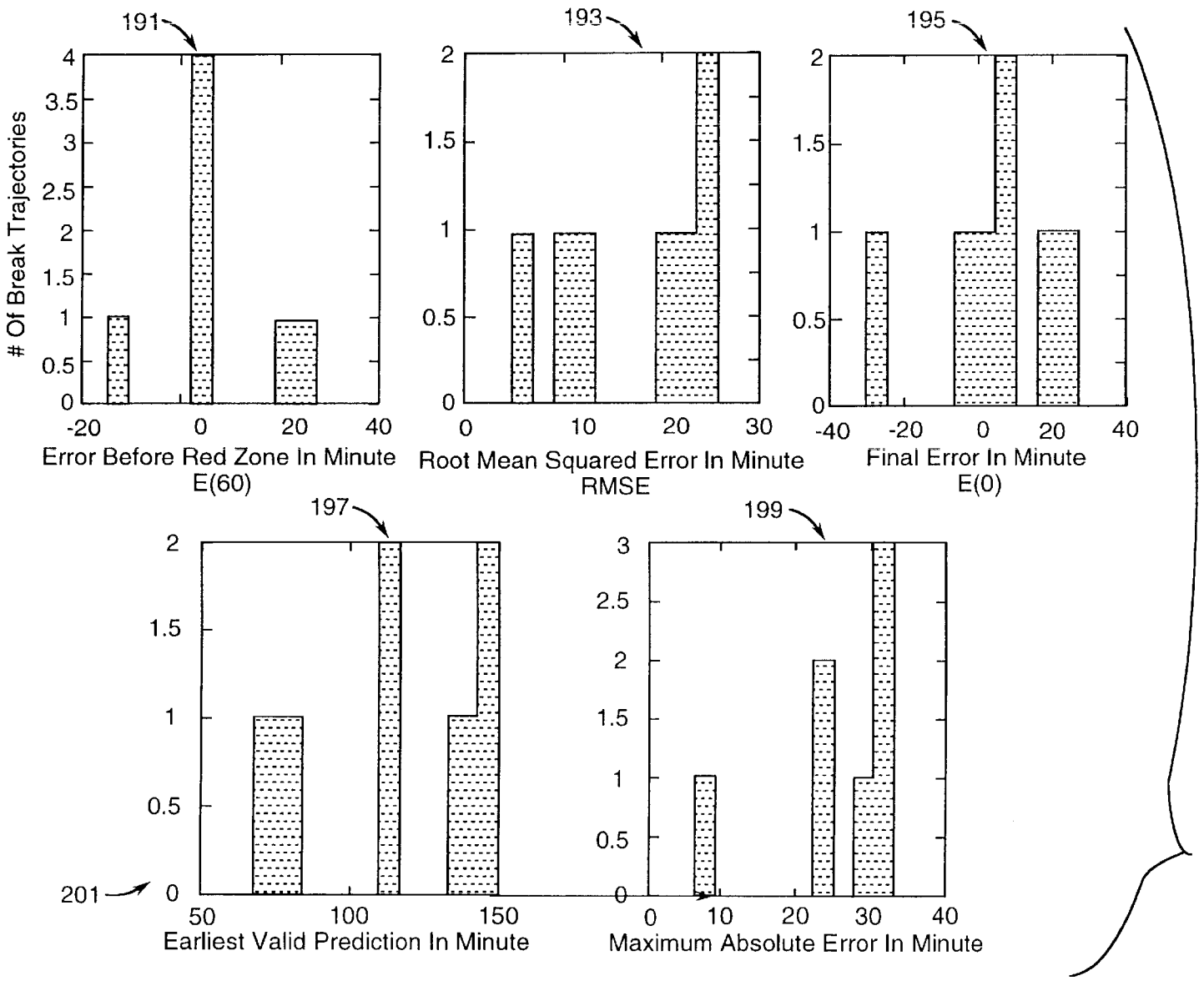
FIG. 20 is a set of histograms illustrating various prediction performance analysis techniques for a high energy group of data.
Figure 21:
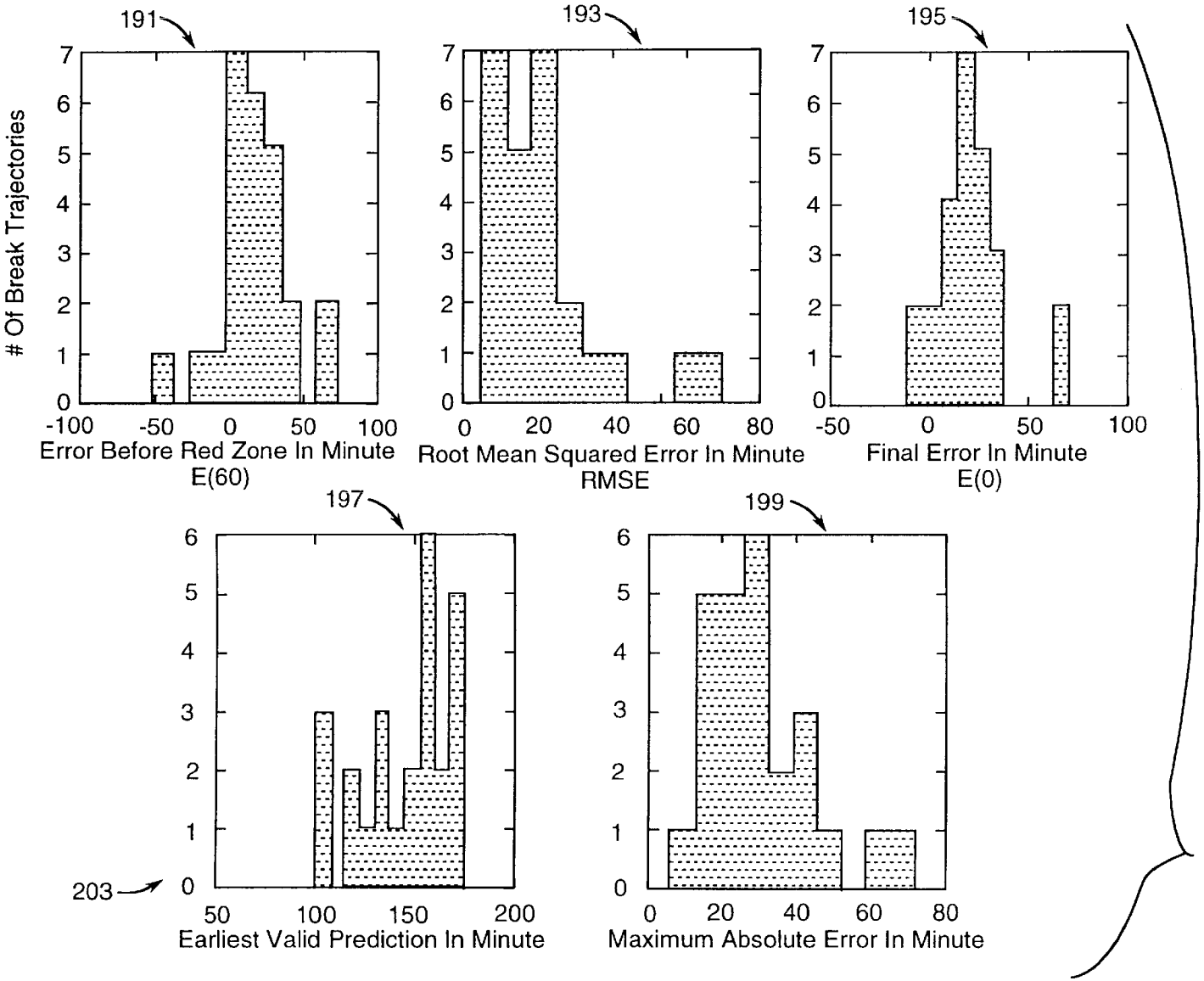
FIG. 21 is a set of histograms illustrating various prediction performance analysis techniques for a mix energy group of data.
Figure 22:
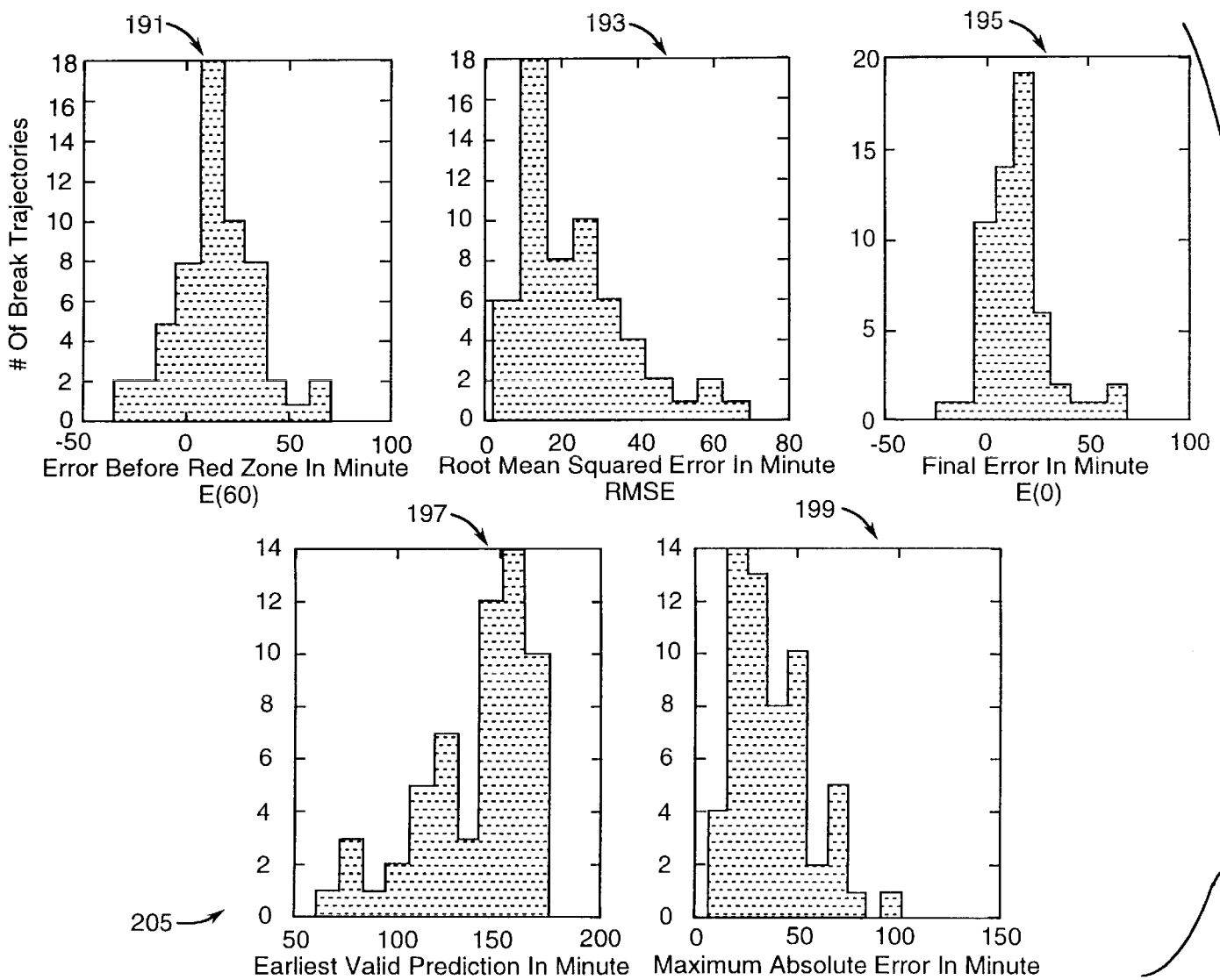
FIG. 22 is a set of histograms illustrating various prediction performance analysis techniques for a low energy group of data.

FIGS. 20–22 show the resultant performance distributions of the high 201, mix 203 and low 205 energy groups, respectively. Of the three groups, the high energy group is the least reliable one, since the model was trained with only 11 trajectories. Referring to FIG. 20, based on the first histogram—showing the distribution of E(60)—it is noted that out of eleven trajectories, seven are correctly classified and four break trajectories are undetected (false negative). The relative high percentage of false negatives in this group is due, in part, to the extremely low number of trajectories available to train the model for this group. The reliability and coverage of the prediction will increase with the size of the training set, as illustrated by the next two groups Referring to FIG. 21, the mix energy group exhibits an improvement in the quality of the prediction, when compared with the high energy group, since the predictive model was trained on 29 trajectories (instead of 11). It is noted from the first histogram—showing the distribution of E(60)—that out of 29 trajectories, the model has 22 correctly classified. Three more trajectories are misclassified (2 false positive and 1 false negative) and only four break trajectories are undetected (false negative).

Referring to FIG. 22, the low energy group exhibits the best prediction quality, since the predictive model was trained on 62 break trajectories. It is noted from the first histogram—showing the distribution of E(60)—that out of 62 trajectories, the model correctly classifies 51 trajectories. Five more trajectories are misclassified (3 false positive and 2 false negative) and only six break trajectories are undetected (false negative).

It should be noted that some of the false positives can be attributed to the closed-loop nature of the data: the human operators are closing the loop and trying to prevent possible breaks, while the model is making the prediction in open-loop, assuming no human intervention.

Two of the more important figures are the first and third histograms in each of FIGS. 20–22, showing the distribution of E(60) and E(0), i.e., the distribution of the prediction error at the time of the alert (red zone) and at the time of the break. An analysis of the predictions is illustrated in Tables 5 and 6 below:

The two histograms show a similar behavior of the error between time=60 and time=0. The variance of at the time of the break (t=0) is slightly smaller than at the time of the alarm (t=60 minutes). Overall, the models show a very robust performance. Furthermore the models slightly overestimate the time-to-break: the mean of the distribution of the final error E(0), is around 20 minutes, (i.e. the models tend to predict the break 20 minutes earlier than it actually occurs). Finally, in analyzing the histograms of the earliest final prediction for the three models, it is noted that reliable predictions are made, on average, 140–150 minutes before the break occurs.

Thus, the model generated by the process performed quite well. Out of a total of 102 break trajectories, 88 predictions were made, of which 80 were correct (according to the lower and upper limits established for the prediction error at time=60, e.g. E(60)). This corresponds to a prediction coverage of 86.3% of all trajectories. The relative accuracy, defined as the ratio or correct predictions over the total amount of prediction made, was 90.9%. The global accuracy, defined as the ratio or correct predictions over the total amount of trajectories, was 78.4%. In summary, we have developed a process that generates a very accurate model that minimizes false alarms (FP) while still providing an adequate coverage of the different type of breaks caused by unknown causes.

The predictive models are preferably maintained over time to guarantee that they are tracking the dynamic behavior of the underlying papermaking process. Therefore, it is suggested to repeat the steps of the model generation process every time that the statistics for coverage and/or accuracy deviate considerably from the ones experienced in building the running model. It is also suggested to reapply the model generation process every time that twenty new break trajectories with unknown causes are acquired.

TABLE 5

Analysis of the Histograms E(60)

| E(60) | | False Negative | | False Positive | Coverage: | Relative Accuracy: | Global Accuracy: |
|---|---|---|---|---|---|---|---|
| | Number of Trajectories | Number of Missed Predictions | Number of Late Predictions | Number of of Early Predictions | Number of Predictions per Trajectory | Correct Predictions per prediction | Correct Predictions per Trajectory |
| Low Energy | 11 | 4 | 0 | 0 | 7/11 = 63.6% | 7/7 = 100.0% | 7/11 = 63.6% |
| Mix Energy | 29 | 4 | 1 | 2 | 25/29 = 86.2% | 22/25 = 88.0% | 22/29 = 75.9% |
| High Energy | 62 | 6 | 2 | 3 | 56/62 = 90.3% | 51/56 = 91.1% | 51/62 = 82.3% |
| Total | 102 | 14 | 3 | 5 | 88/102 = 86.3% | 80/88 = 90.9% | 80/102 = 78.4% |

TABLE 6

Analysis of the Histograms E(0) - Final Error

| E(0) | | False Negative | | False Positive | Coverage: | Relative Accuracy: | Global Accuracy: |
|---|---|---|---|---|---|---|---|
| | Number of Trajectories | Number of Missed Predictions | Number of Late Predictions | Number of of Early Predictions | Number of Predictions per Trajectory | Correct Predictions per prediction | Correct Predictions per Trajectory |
| Low Energy | 11 | 4 | 1 | 0 | 7/11 = 63.6% | 6/7 = 85.7% | 6/11 = 54.5% |
| Mix Energy | 29 | 4 | 0 | 2 | 25/29 = 86.2% | 23/25 = 92.0% | 23/29 = 79.3% |
| High Energy | 62 | 6 | 0 | 4 | 56/62 = 90.3% | 52/56 = 92.9% | 52/62 = 83.9% |
| Total | 102 | 14 | 1 | 6 | 88/102 = 86.3% | 81/88 = 92.0% | 81/102 = 79.4% |

As mentioned earlier, the rules from the model can be used to isolate the root cause of any predicted web break. In particular, in predicting the paper web time-to-break in the paper machine, the rule set may be utilized to determine that the root cause of this predicted break may be due to certain sensor measurements not being within a certain range. Therefore, the paper machine may be proactively adjusted to prevent a web break.

The following is a list of software tools that may be utilized for the processes of the present invention:

1 Data scrubbing—the Excel™ software program or the MATLAB™ software program (to read files); SAS™ software program (to scrub data files)

2 Data segmentation—SAS™ software program

3 Variable selection—SAS™ software program; S+CART™ software program; Excel™ software program or MATLAB™ software program (to visualize variables over time)

4 Principal Components Analysis (PCA)—SAS™ software program

5 Filtering—MATLAB™ software program

6 Smoothing—MATLAB™ software program

7 Clustering—SAS™ software program

8 Normalization—GNU C™ software program

9 Transformation—MATLAB™ software program

10 Shuffling—GNU C™ software program

11 ANFIS—GNU C™ software program

12 Trending—MATLAB™ software program

13 Performance analysis—MATLAB™ software program

As one skilled in the art will realize, other similar software may be utilized to produce similar results, such as the Splus™ program, the Mathmatica™ software program and the MiniTab™ software program.

Although this invention has been described with reference to predicting the time-to-break and isolating the root cause of the break in the wet-end section of the paper machine, this invention is not limited thereto. In particular, this invention can be used to predict the time-to-break of a paper web and isolate the root cause in other sections of the paper machine, such as the dry-end section and the press section.

It is therefore apparent that there has been provided in accordance with the present invention, a system and method for predicting a time-to-break of a paper web in a paper machine that fully satisfy the aims, advantages and objectives hereinbefore set forth. The invention has been described with reference to several embodiments; however, it will be appreciated that variations and modifications can be effected by a person of ordinary skill in the art without departing from the scope of the invention.

What is claimed is:

1. A system for predicting a paper web break in a paper machine, comprising:

a plurality of sensors for obtaining a plurality of measurements from the paper machine, each of the plurality of measurements relating to a predetermined paper machine variable;

a processor for processing each of the plurality of measurements into modified break sensitivity data; and a break predictor responsive to the processor for predicting a time-to-break of the paper web from the plurality of processed measurements.

2. The system according to claim 1, wherein the break predictor comprises a predictive model.

3. The system according to claim 2, wherein the predictive model comprises a neuro-fuzzy system.

4. The system according to claim 2, wherein the predictive model comprises an adaptive network-based fuzzy inference system.

5. The system according to claim 4, wherein the adaptive network-based fuzzy inference system is trained with historical web break data.

6. The system according to claim 1, wherein the modified break sensitivity data comprise time-based transformations of the plurality of measurements.

7. The system according to claim 1, wherein the modified break sensitivity data comprise principal components of the plurality of measurements.

8. The system according to claim 1, wherein the break sensitivity data comprise noise-reduced and feature-enhanced transformations of the plurality of measurements.

9. The system according to claim 1, further comprising a fault isolator responsive to the break predictor for determining the paper machine variables affecting the predicted time-to-break of the paper web.

10. The system according to claim 9, wherein the fault isolator comprises an adaptive network-based fuzzy inference model having a set of rules linking paper machine variables to the predicted time-to-break of the paper web.

11. The system according to claim 9, wherein the fault isolator isolates the paper machine variables that are root causes for the predicted time-to-break of the paper web.

12. The system according to claim 1, further comprising an indicator mechanism for updating the status of the machine by indicating the predicted paper web time-to-break.

13. The system according to claim 1, further comprising a feedback mechanism for adjusting the performance of the break predictor.

14. The system according to claim 1, wherein the processor further processes the predicted time-to-break and prior predicted times-to-break into a final predicted time-to-break.

15. A system for predicting a paper web break in a paper machine, comprising:

a plurality of sensors for obtaining a plurality of measurements from the paper machine, each of the plurality of measurements relating to a predetermined paper machine variable;

a processor for processing each of the plurality of measurements into modified break sensitivity data comprising time-based transformations of the plurality of data; and a break predictor responsive to the processor for predicting a time-to-break of the paper web from the plurality of processed measurements, wherein the break predictor comprises a predictive model.

16. The system according to claim 15, wherein the predictive model comprises a neuro-fuzzy system.

17. The system according to claim 16, wherein the predictive model comprises an adaptive network-based fuzzy inference system.

18. The system according to claim 17, wherein the modified break sensitivity data comprise principal components of the plurality of measurements.

19. The system according to claim 18, further comprising a fault isolator that isolates the paper machine variables that are root causes for the predicted time-to-break of the paper web.

20. The system according to claim 18, further comprising an indicator mechanism for updating the status of the paper machine by indicating the predicted paper web time-to-break.

21. The system according to claim 18, further comprising a feedback mechanism for adjusting the performance of the break predictor.

22. The system according to claim 18, wherein the processor further processes the predicted time-to-break and prior predicted times-to-break into a final predicted time-to-break.

23. A method for predicting a paper web break in a paper machine, comprising:

obtaining a plurality of measurements from the paper machine, each of the plurality of measurements relating to a predetermined paper machine variable;

processing each of the plurality of measurements into modified break sensitivity data; and predicting a time-to-break for the paper web within the paper machine from the plurality of processed measurements.

24. The method according to claim 23, wherein predicting the time-to-break for the paper web comprises applying a predictive model.

25. The method according to claim 23, wherein predicting the time-to-break for the paper web comprises applying a neuro-fuzzy system.

26. The method according to claim 23, wherein predicting the time-to-break for the paper web comprises applying an adaptive network-based fuzzy inference system.

27. The method according to claim 23, further comprising training the adaptive network-based fuzzy inference system with historical web break data.

28. The method according to claim 27, further comprising testing the trained adaptive network-based fuzzy inference system with the historical break data to test how well the system predicts the time-to-break.

29. The method according to claim 27, wherein the training comprises preprocessing the historical web break data.

30. The method according to claim 29, wherein the preprocessing comprises:

reducing the quantity of the historical web break data;

reducing the number of variables contained in the historical web break data;

transforming the values of the historical web break data;

enhancing features that affect web break sensitivity from the historical web break data; and generating the adaptive network-based fuzzy inference system to predict the time-to-break.

31. The method according to claim 23, wherein the processing of the plurality of measurements into modified break sensitivity data further comprises time-based transformations of the plurality of measurements.

32. The method according to claim 23, wherein the processing of the plurality of measurements into modified break sensitivity data further comprises transforming the plurality of measurements into principal components for web breakage.

33. The method according to claim 23, further comprising processing the predicted time-to-break and prior predicted times-to-break into a final predicted time-to-break.

34. The method according to claim 23, further comprising adjusting the predicting of the time-to-break based on an analysis of the performance of the predicted time-to-break.

35. The method according to claim 23, further comprising updating the status of the paper machine by indicating the predicted time-to-break.

36. The method according to claim 23, further comprising isolating the paper machine variables affecting the predicted time-to-break.

37. A method for predicting a paper web break in a paper machine, comprising:

obtaining a plurality of measurements from the paper machine, each of the plurality of measurements relating to a predetermined paper machine variable;

performing a time-based transformation of each of the plurality of measurements to produce modified break sensitivity data; and predicting a time-to-break for the paper web within the paper machine from the plurality of processed measurements by applying a predictive model.

38. The method according to claim 37, wherein predicting the time-to-break for the paper web comprises applying a neuro-fuzzy system.

39. The method according to claim 37, wherein predicting the time-to-break for the paper web comprises applying an adaptive network-based fuzzy inference system.

40. The method according to claim 39, further comprising training the adaptive network-based fuzzy inference system with historical web break data.

41. The method according to claim 40, further comprising testing the trained adaptive network-based fuzzy inference system with the historical break data to test how well the system predicts the time-to-break.

42. The method according to claim 39, wherein performing the time-based transformation of the plurality of measurements into modified break sensitivity data further comprises transforming the plurality of measurements into principal components for web breakage.

43. The method according to claim 42, further comprising processing the predicted time-to-break and prior predicted times-to-break into a final predicted time-to-break.

44. The method according to claim 43, further comprising adjusting the predicting of the time-to-break based on an analysis of the performance of the predicted time-to-break.

45. The method according to claim 44, further comprising updating the status of the paper machine by indicating the predicted time-to-break.

46. The method according to claim 45, further comprising isolating the paper machine variables affecting the predicted time-to-break.

* * * * *